US008678943B2

(12) United States Patent
Mooney

(10) Patent No.: US 8,678,943 B2
(45) Date of Patent: Mar. 25, 2014

(54) APPARATUS AND METHOD FOR ANALYSING A GOLF SWING

(76) Inventor: Brian Francis Mooney, Dun Laoghaire (IE)

( * ) Notice: Subject to any disclaimer, the term of this patent is extended or adjusted under 35 U.S.C. 154(b) by 230 days.

(21) Appl. No.: 12/741,004

(22) PCT Filed: Nov. 5, 2008

(86) PCT No.: PCT/EP2008/065025
§ 371 (c)(1),
(2), (4) Date: Jun. 8, 2010

(87) PCT Pub. No.: WO2009/060010
PCT Pub. Date: May 14, 2009

(65) Prior Publication Data

US 2010/0267462 A1 Oct. 21, 2010

(30) Foreign Application Priority Data

Nov. 5, 2007 (IE) ..... S2007/0800

(51) Int. Cl.
*A63B 69/36* (2006.01)

(52) U.S. Cl.
USPC ..... 473/269; 473/266; 473/267; 473/268; 473/270; 473/219; 473/222; 702/41; 702/42; 702/43; 702/44

(58) Field of Classification Search
USPC ..... 473/202, 266–270; 702/41–44
See application file for complete search history.

(56) References Cited

U.S. PATENT DOCUMENTS

| | | | | |
|---|---|---|---|---|
| 5,419,562 | A * | 5/1995 | Cromarty | 473/269 |
| 5,772,522 | A | 6/1998 | Nesbit et al. | |
| 6,039,658 | A * | 3/2000 | Cecchin | 473/269 |
| 6,402,635 | B1 | 6/2002 | Nesbit et al. | |
| 7,264,554 | B2 * | 9/2007 | Bentley | 473/222 |
| 7,406,386 | B2 | 7/2008 | Brett et al. | |
| 7,871,333 | B1 * | 1/2011 | Davenport et al. | 473/223 |
| 2005/0255932 | A1 * | 11/2005 | Erickson et al. | 473/266 |
| 2007/0192045 | A1 * | 8/2007 | Brett et al. | 702/42 |
| 2007/0207873 | A1 * | 9/2007 | Rose | 473/207 |

FOREIGN PATENT DOCUMENTS

| | | |
|---|---|---|
| EP | 1 810 724 | 7/2007 |
| JP | 06-142260 | 5/1994 |
| WO | 2005/088518 | 9/2005 |
| WO | 2006/027626 | 3/2006 |
| WO | 2006/120658 | 11/2006 |

* cited by examiner

*Primary Examiner* — Ronald Laneau
*Assistant Examiner* — Justin Myhr

(57) ABSTRACT

This invention is an apparatus and method for measuring or analyzing a golf swing. Measurement or analysis is made relative to energy generation and transfer through a player's body and club. The measurement or analysis data is principally obtained from the player's ground-reaction forces. Processed signals are analyzed with an artificial intelligence system. Ground-reaction forces relate to reaction forces which occur between a standing surface and the player's feet. The apparatus and method measures or analyses a golf swing in an automatic manner or in an automatic and interactive manner.

28 Claims, 18 Drawing Sheets

APPARATUS AND METHOD FOR ANALYSING A GOLF SWING

The present invention relates to an apparatus and method for measuring or analysing a golf swing.

U.S. Pat. No. 5,823,878 discloses a method and apparatus which uses two video cameras to capture a golf swing motion. The apparatus produces various graphs which are used by a technician or expert to analyse the swing. Analysis is not automatic and is dependent on the knowledge and skill of a technician or expert. The apparatus and its operation are of relatively high cost and complexity.

WO 2004/049944 A1 discloses a method and apparatus which uses a set of motion sensors attached to the player to capture a golf swing motion. The apparatus produces various data which are used by a technician or expert to analyse the swing. Similar to U.S. Pat. No. 5,823,878, cited above, analysis is not automatic and is dependent on the knowledge and skill of the technician or expert. The apparatus and its operation are also of relatively high cost and complexity.

U.S. Pat. No. 7,264,554 discloses a method and apparatus which uses at least one video camera together with a set of motion sensors attached to the player to capture a golf swing motion. In one operating mode, the analysis is not automatic, and the system produces various visual results which require human intervention to analyse the swing. In another operating mode, the system is said to automatically generate a number termed a 'kinetic index score'. However, this score number appears to be of very little value in correctly analysing a swing. Similar to the inventions cited above, the apparatus and its operation are again of relatively high cost and complexity.

The present invention provides an apparatus and method for measuring or analysing a golf swing, where measurement or analysis is made relative to energy generation and transfer through the body and club.

The present invention also provides an apparatus and method for measuring or analysing a golf swing, where data is principally obtained from a player's ground-reaction forces and where processed signals are analysed with artificial intelligence. The term 'ground-reaction force' relates to a reaction force which occurs between a standing surface and a subject's or player's feet.

The present invention also provides more specifically to an apparatus and method which measures or analyses a golf swing in an automatic manner or in an automatic and interactive manner.

The invention is more specifically defined in the appended claims which are incorporated into this description by reference thereto.

A BRIEF SUMMARY OF THE INVENTION

A golf swing is analyzed and evaluated by measuring energy generation and transmission through a player's body. The measurements may be analyzed or evaluated against criteria or rules specifying how a swing is influenced by such measurements, with analysis aided by modeling the player and club as a chain of connected rigid segments. Artificial intelligence, implemented with a processor system, can be used to extract the measurements from ground reaction forces with repetition measurements taken to isolate and represent forces associated with specific body movement generated from the beginning to the end of the golfer's swing. The invention provides a practical method and apparatus for measuring and analyzing the swing which does not rely on an empirical type of coaching techniques. It additionally provides an advantageous method and apparatus for extracting the energy-related measurements, using inexpensive sets of force-plate-type equipment, which can be compared with both the progress of the golfer and compared with data reflecting comparative experts' swings.

BRIEF DESCRIPTION OF DRAWINGS

The invention will now be described, by way of example only, with reference to FIG. 1 to FIG. 18.

DETAILED DESCRIPTION

Figure 1:
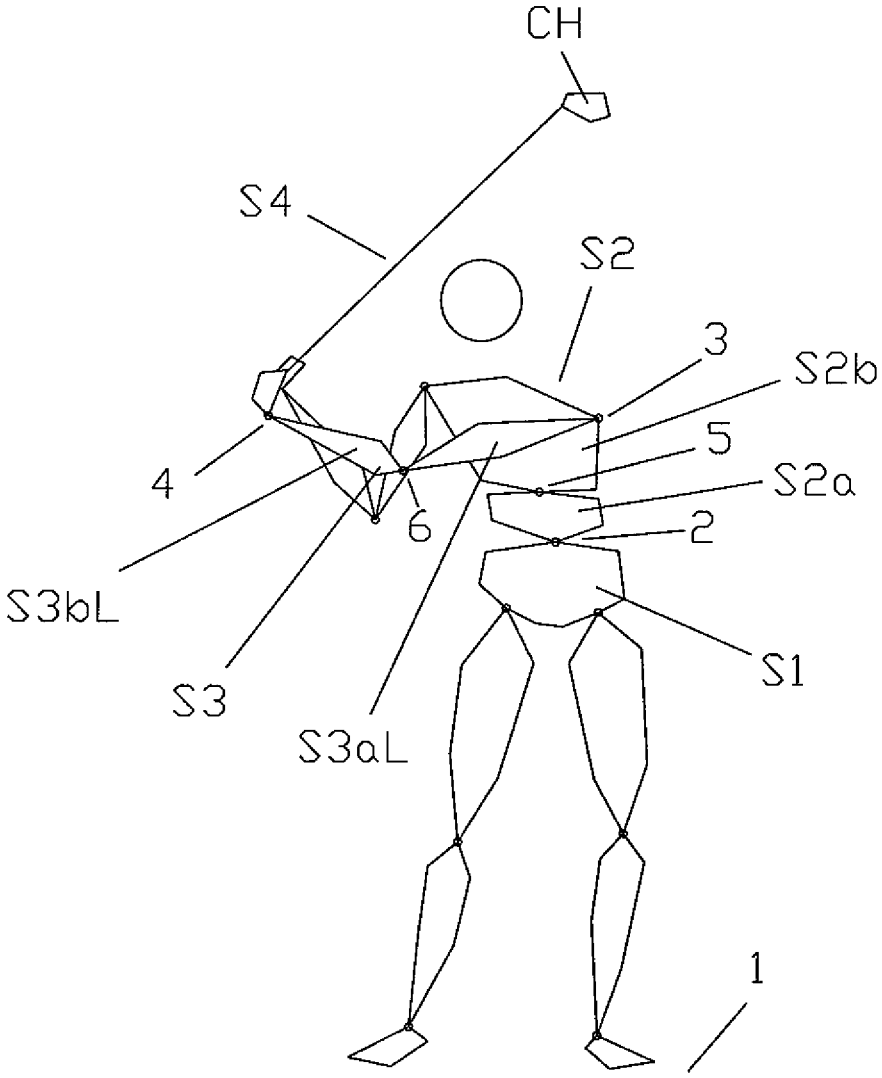
FIG. 1 is a schematic front view of a model of a player and club in a downswing position, showing some of the principal segments, sub-segments and joints.

Throughout the description and claims, an apparatus and method are described for a player who strikes the ball in a direction towards a target, which typically corresponds to the hole on a green. The direction towards the target will be referred to as the target direction and the player's hand or foot closest to the target may be referred to as the target-side hand or foot. A right handed player will normally strike the ball from right to left. Takeaway refers to the time event where the player moves the club away from the address position at the commencement of the backswing. Impact refers to the time event where the club head strikes the ball, and follow-through refers to the portion of the swing which takes place after impact. Different points in the backswing and downswing can be conveniently tracked by reference to the angle between the club shaft and a vertical axis, in a frontal view at the player, with BS, DS and FT referring to backswing, downswing and follow-through, respectively. Takeaway occurs at approximately BS0°, progressing to BS90° when the club shaft attains a horizontal position and to BS180° when the club shaft is orientated vertically upwards, continuing to the end of the backswing. The club reverses rotation in the downswing, with the club shaft attaining a vertical upwards position at DS180°, progressing to a horizontal position at DS90° and impact at approximately DS0°. It then continues into the follow-through, attaining FT90° at a horizontal position. Intermediate angular positions are similarly expressed at the relevant angle.

The principal objective of a drive swing is to make the ball travel as far as possible in an intended or target direction. This is achieved by hitting the ball at very high club head speed and with accurate contact between the clubface and ball. The principal objective of most other swings, is to make the ball travel a desired distance which is less that the maximum distance which the player can hit the ball, again in an intended or target direction. Throughout the specification and claims, the term swing is understood to apply to all golf strokes or swings other than the putter stroke.

Achieving the very high club head speeds typical of competent drive swings requires a surprisingly complex set of activities, which appear not to be properly understood by golfers or coaches. There appears to be a general belief among players, coaches and other involved professionals that the individual player's golf swing is beyond scientific-type evaluation and can only be effectively analysed and improved by the human intervention of coaching skills and experience. This general belief appears to extend across all golf swings.

An aspect of the present invention is an insight that an individual player's swing can be scientifically evaluated and analysed without human intervention, by identifying, measuring and analysing the elements of energy generation and transmission through the body. This insight applies equally to swings with the objective of obtaining maximum club head speed and those with the objective of obtaining club head speeds less than the maximum of which the player is capable. This insight is far from obvious, because the hitherto secrets of the golf swing apply equally to swings requiring maximum and minimal energy. Players and coaches will also be aware that attempts to hit a ball harder usually result in reduced performance.

Another related aspect of the invention involves an appreciation that, for typical accomplished players, many of the important elements of energy generation and transmission through the body remain the same or similar from one swing to another, and an analysis of one swing can be valid for all characteristic swings by that player.

An additional aspect of the invention relates to an appreciation that players tend to use a similar type of energy generation and transmission through the body across a range of swings. In particular, the type of energy generation and transmission used for the longer clubs, such as the driver, tend to form the template for energy generation and transmission across all the complete range of club swings. Thus the identification and improvement of energy generation and transmission for one such club can be advantageously applied to other clubs across the range.

In addition to generating very high club head speed, where this is required, the proper execution of accomplished energy generation and transmission through the body is also fundamental to promoting accuracy in shots. Tests indicate that swings with accomplished generation and transmission of energy have minimal wasted energy, tend to be more consistent, comprise smoother movements and minimise the need to brace the body to absorb unused energy in the follow-through. These characteristics facilitate and improve the player's control and accuracy in executing the shot.

The specific important swing parameters which are directly relevant to energy generation and transmission through the body and ultimately to the club head, shall, for ease of description, be referred to as 'energy-parameters'. Information or parameters which are used to determine or calculate energy-parameters shall also be referred to as energy-parameters. An aspect of the invention is an identification of key energy-parameters.

The criteria or rules specifying how a swing is influenced by its energy-parameters, shall, for ease of description, be referred to as 'optimising-rules'. These criteria may be presented in various ways, but for consistency in the present specification, where possible the optimising rules shall be presented as criteria representing more accomplished swings. Progressive failure to follow such optimising-rules will correspond to less accomplished swings or errors in swings.

Figure 2:
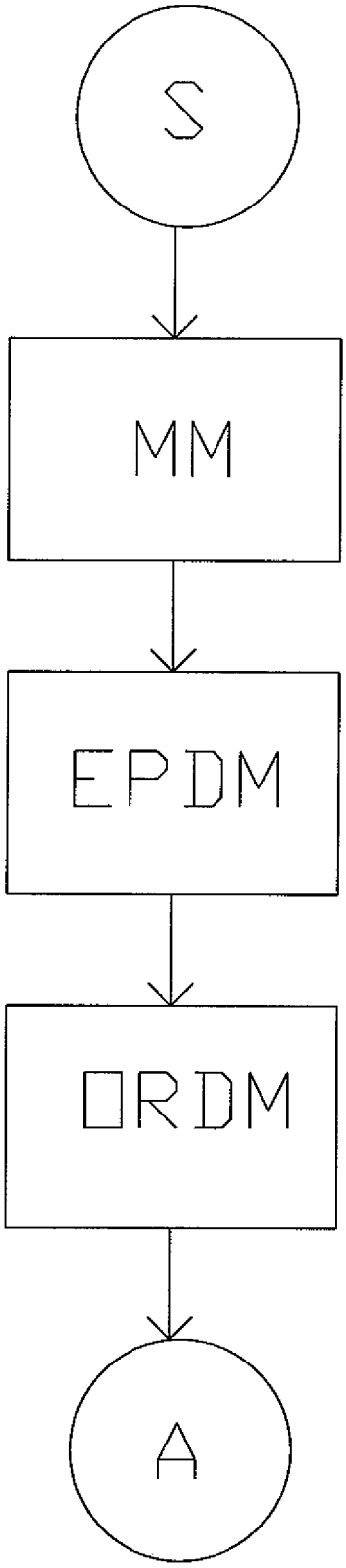
FIG. 2 is a block diagram showing sequential steps in measuring or analysing a swing using energy-parameter data and optimisation-rule data.
Figure 3:
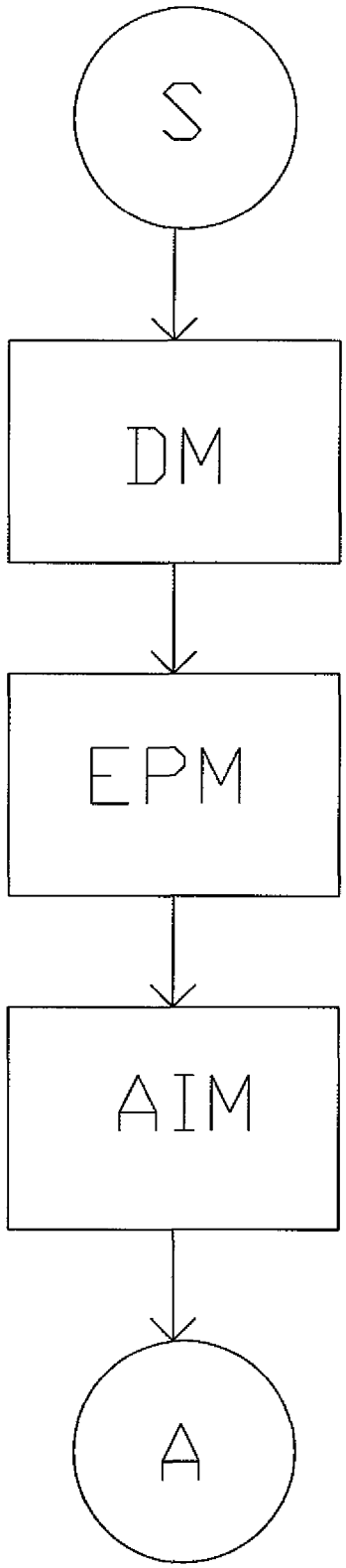
FIG. 3 is a block diagram showing principal optimum local energy generation sequences in a downswing.

FIG. 2 is a block diagram showing sequential steps where a system is used to analyse a swing using energy-parameter data and optimisation-rule data. Descriptive abbreviations used in the figure are shown in parenthesis in the following brief description. Information on the swing (S), which allows measurement or determination of its energy-parameters, is obtained by a measuring means (MM). An energy-parameter data means (EPDM) determines the energy-parameters from the information. An optimising-rules data means (ORDM) provides the criteria against which the energy-parameters are judged, allowing an analysing means to produce an analysis (A) of the swing.

To aid identification and analysis of the energy-parameters, the player and club are modelled as a kinetic chain of segments linked by universal joints. Reference is now made to FIG. 1, which shows a schematic front view of a model of a player and club in a mid downswing position.

The kinetic chain can be simplified to a single chain of four linked segments, although other more sophisticated embodiments can be used. The use of four segments simplifies the analysis and description, while retaining most of the accuracy of more complex models. For convenience, the first, second, third and fourth segments of the chain shall be termed 'S1', 'S2', 'S3' and 'S4', respectively. Alternatively, they may for convenience be referred to as the 'pelvis', 'trunk', 'arms' and 'club' segments, although these are not anatomically correct descriptions of the segments. The components of the chain are arranged in the following order in a player who hits from right-to-left, which is typical of a right-handed player. A mirror-image arrangement applies to a player who hits from left-to-right. Using the reference numerals or letters in the figure, the first segment S1 is the lower body or 'pelvis' segment. It comprises the pelvis and legs and is flexibly connected to the ground (1) via the feet. The second segment S2 is the upper body segment and comprises the shoulders and trunk above the waist. It can be treated as a largely rigid segment flexibly connected to S1 via a universal joint at the spinal section of the waist (2). The third segment S3 is the arms segment. It comprises both arms and is universally connected to S2 via the left shoulder joint (3). The fourth segment S4 comprises the hands and club. It is treated as a largely rigid segment universally connected to S3 via the left wrist (4). The left arm is treated as a largely rigid segment which remains substantially straight over part, although not all, of the swing, connecting S2 and S4. The right arm bends through the swing and although connecting S2 and S4, it does not directly connect with the joints of the chain, but serves to partly power and control the swing. The feet-ground connection is designated the proximal end of the chain and the club head end (CH) is designated the distal end. A segment under discussion may be termed the 'instant' segment.

For reasons which will become apparent later in the specification, some of the segments are also divided into sub-segments. The trunk segment is divided into a lower trunk segment S2*a* and an upper trunk segment S2*b*, joined at a central spinal position (5). This is a somewhat arbitrary division reflecting the flexibility of the spine and lower back. Each arm is also divided into two sub-segments, the left arm divided into an upper arm segment S3*a*L and a lower arm segment S3*b*L, with a joint at the left elbow (6). The right is similarly divided into two sub-segments S3*a*R and S3*b*R. It is noted that there are distinctions between segments and sub-segments, and they are treated differently in the analysis.

Energy Generation and Transfer

The segments of the chain obtain kinetic energy both by generation of energy from muscles associated with movement of the segment itself and by transfer of energy to them from proximal segments. In all golf swing, whether requiring maximum distance or not, the ultimate goal of the kinetic chain is to transfer energy as efficiently as possible to the distal club head end of the chain by the time impact occurs with the ball. The total kinetic energy at any point in the swing will be the sum of the kinetic energies of the individual segments. If the segment has linear movement, its linear kinetic energy can be determined as $\frac{1}{2}$ m.v$^2$, where m and v are segment mass and linear velocity, respectively. If the segment has angular movement, its angular kinetic energy can be determined as $\frac{1}{2}$ I.w$^2$, where I and w are segment moment of inertia and angular velocity, respectively. Although linear and rotary kinetic energies are distinct at any instant in time, they can convert wholly or in part from one to the other over the course of the swing.

The immediate generation of energy in a segment from muscles associated with the segment shall, for convenience, be termed 'local' energy and the work producing it termed 'local' work. In the case of S1, these 'local' muscles principally comprise the muscles of the thighs and legs, delivering rotation and linear translation of the pelvis. In the case of the other segments, local energy largely arises from the actions of muscles which principally act in association with the joint between the immediate and proximal segment. Thus S2, S3 and S4 obtain local energy from the actions of muscles which principally act in association with the joints between S1 and S2, S2 and S3, and S3 and S4, respectively. 'Local' energy provides the initial source of all energy generated and transmitted in the golf swing.

An important mechanism by which energy is transferred from one segment to another along the chain is by 'latching' the instant segment to an accelerating proximal segment, such that the instant segment is accelerated along with the proximal segment by energy which is generated at, or existing at, the proximal segment. The process shall, for convenience, be termed 'latch' transfer, with segments being 'latched' and 'unlatched' when the process commences and terminates, respectively. Latching may also occur along a chain of segments latched together, with all segments in the chain being accelerated by energy which is being generated at or existing at the most proximal segment in the latched chain. Typically, an instant segment will latch to a proximal segment early in its movement, obtaining relatively low speed energy in the process, and will later 'unlatch' when it accelerates to greater speed than the proximal segment. Latch transfer occurs both for rotary and linear motion.

When local energy is used to launch an instant segment off a proximal segment, momentum is transferred between it and the proximal segment. Kinetic energy is usually transferred between segments when this occurs, and the process shall, for convenience, be termed 'launch' transfer.

Over the course of the swing, the combined segments, S3 and S4, sling about the proximal segments from the connection at the left shoulder joint. In addition to being powered by local energy from the muscles of the shoulders and upper arms rotating S3, energy is also transferred from the proximal segments by forces at the left shoulder pulling on this sling arrangement. This transfer of non-local energy from the proximal segments shall, for convenience, be termed 'sling' transfer, as a similar energy transfer occurs in the familiar sling or slingshot. The pulling forces are caused by rotation and linear translation of the left shoulder joint powered by the proximal segments. The power may arise remotely from the proximal segments, or from deceleration of the angular or linear movement of segment S2. Unlike latch transfer, sling transfer can also occur from a decelerating segment, because the angular or linear velocities of the involved segments are not locked at the same angular speeds. Over certain portions of the sling arc, forward translation or rotation of the left shoulder accelerates the distal end of the slingshot, including a decelerating motion of the left shoulder from a higher forward speed.

Another type of inter segment energy transfer which occurs in the swing shall, for convenience, be termed 'flail' transfer, as it occurs in the familiar weapons and agricultural implements of that name. This occurs where two connected segments are rotating and translating in the same direction, both comprising kinetic energy, and the distal end of the proximal segment decelerates, causing the proximal end of the distal segment to decelerate with it and simultaneously causing the distal end of the distal segment to accelerate at an increased rate, due to the kinetic energy of the segment being largely conserved. Where retardation of the proximal segment has occurred largely without loss or backward transfer of energy, as is the case with the historic flail, the kinetic energy change in the proximal segment is also transferred to the distal end of the distal segment. In an accomplished swing, the segments S3 and S4 act as a controlled two-part flail, allowing the distal club head end achieve much higher speed than would be possible if S3 and S4 acted as a single segment. By holding S3 and S4 latched at an approximate right angle, or a little less, up to a critical point in the downswing, the flailing mechanism then opens, due to centrifugal force, to cause the club head distal end to rapidly increase its rate of acceleration, while at the same time slowing S3 and the proximal end of S4. This results in a dramatic transfer of kinetic energy to the distal end. Flail transfer can also occur between other connected segments.

A further, less critical, type of inter segment energy transfer occurs where the rotating player reduces his or her angular moment of inertia by reducing the effective radius of rotation of the body about the general axis of rotation, by drawing the proximal end of S4 and distal end of S3 closer to the body in the later stages of downswing. Because momentum is conserved, this causes an overall increase in angular speed and energy, which in an accomplished swing is transferred to the club head. This type of transfer shall be referred to as 'radius-reduction' transfer of kinetic energy.

Kinetic energy is converted to potential energy in the backswing when segments S3 and S4 are gravitationally elevated and the player's body is elastically deflected into the various segment TOB positions. The majority of this energy is usually recovered by re-conversion to kinetic energy in the downswing. Kinetic energy is also converted to potential energy in elastic deflection of the club shaft during the downswing. Some of this energy can be recovered prior to impact in an accomplished swing.

Kinetic energy is also used in a process which is similar to conversion to potential energy, because it leads to a situation where additional kinetic energy may later be realised. This process relates to stretching of muscles used in the swing in a process which is commonly referred to as 'stretch-shortening' in biomechanics literature. In relevant circumstances, muscles which are stretch-shortened are capable of producing energy at a significantly greater rate and in greater quantity than would otherwise be the case. This phenomenon is used in accomplished swings to use kinetic energy in the backswing and early downswing as a means of generating greater kinetic energy at greater rates later in the downswing.

Energy Generation and Transmission Common to Most Swings

Energy generation commences in the backswing, where the segments are rotated, clockwise in plan view, to set up the segment TOB positions. 'TOB' alludes to the common golf expression 'top-of-backswing' and refers to the extreme movement position of the segment in the backswing, before the movement is reversed to commence the downswing (although usually only referring to the club segment in common golf parlance). The segments usually reach their respective TOB positions at different times. The terms 'TOB-1', 'TOB-2', 'TOB-3' and 'TOB-4' are used to refer to the top of backswing for segments 1, 2, 3 and 4, respectively. Downswing commences from TOB for each segment, and the various segments usually commence their downswing rotation at different times, with the downswing direction of rotation being anticlockwise in plan view. Segments may momentarily dwell at TOB or effectively reverse instantaneously at TOB.

The downswing may commence with generation of local energy in rotating S1, starting from TOB-1. Some or all of the other segments, S2, S3 and S4, may latch in chain format to S1, causing these segments to rotate with energy transferred by latching from local energy generated at S1.

Typically, as the downswing progresses, local energies cause S2 to commence rotation relative to S1, and S3 to commence rotation about the left shoulder joint. These movements contribute to the required compound rotation in the inclined swing plane. These various movements cause energy to transfer along the chain by sling transfer.

Potential energy is generated in raising the gravitational elevation of S3 and S4 in the backswing and early downswing. This energy is gradually reconverted to kinetic energy as the swing progresses to impact with the ball. This source of energy is substantially identical for accomplished and unaccomplished swings and therefore shall not be discussed further in this specification, although it is a significant component of the swing.

The arm and club segments, S3 and S4, commence at an angle which is significantly less than a straight angle at the commencement of the downswing. They will straighten out, either gradually or in a controlled manner, as the swing progresses and the club head is pulled outwards by centrifugal force, and may approximate a straight angle by the time the club head makes contact with the ball. The relative angle between S3 and S4 will be influenced by latching or unlatching if this occurs between these segments during the swing, as latching may be used to maintain the initial angle between the segments. In favourable circumstances, unlatching these segments will cause energy to additionally transfer along the chain by flail transfer.

Local energy may be used to power the rotation of S4.

Local energies launching S2, S3 and S4 off their respective proximal segments, may each cause energy to additionally transfer along the chain by launch transfer.

Energy Generation and Transmission in Optimised Swings

Energy generation commences in the backswing, which comprises a much lower level of energy generation and transmission than the downswing. In an optimal backswing, the segments are moved in a smooth and coordinated manner to set up the TOB positions in the time sequence TOB-1, TOB-2, TOB-3 and TOB-4. Downswing commences from TOB for each segment, and in an optimal swing will commence in the same order in which the backswing ended, that is TOB-1, TOB-2, TOB-3 and TOB-4. In an accomplished swing, each TOB typically changes rapidly from backswing to downswing, such that commencement of the overall downswing sequence of segments overlaps with the termination of the overall backswing sequence of segments.

One of the most important commencing activities in the downswing is the generation of local energy in rotating S1, starting from TOB-1. In an accomplished swing, S2, S3 and S4 will latch in chain format to S1 in timed sequence commencing at TOB-2, TOB-3 and TOB-4, respectively, causing these segments to rotate with energy transferred by latching from local energy generated at S1.

Again in an accomplished swing, some degree of additional body deflection, leading to muscle stretch-shortening, occurs in the early stages of downswing for segments S2, S3 and S4, which results in the S1 latch being progressively developed. The most important example of this process occurs in the case of S1 and S2. When S2 commences its latch to S1 at TOB-2, S1 is clearly rotating at greater speed than S2. This situation remains for a short period, with the relative angle between the pelvis and shoulder gradually increasing. Eventually, S2 catches up in angular speed with S1, at which point the S1-S2 latch is deemed to be fully in place. At this point, the angle between pelvis and shoulders is at a maximum and stretch-shortening of muscles between S1 and S2 is completed. These are the muscles associated with generation of local energy in S2. This point is sometimes referred as the point of 'X-factor stretch' in coaching literature and will be herein referred to by the similar term 'S1-S2-stretch'. The additional relative rotation of S1 and S2 varies over about 0-30°. The higher values can be mechanically counterproductive and may lead to injury. Accomplished players will achieve values in the mid region of this range. Similarly, the points at which the S3 and S4 segments catch up on their proximal segment angular speeds, in the initial latch process, will be referred to as the points of 'S2-S3-stretch' and 'S3-S4-stretch', respectively. These stretches may optionally be calculated over sub-segments, for example S1-S2-stretch may be viewed and calculated as S1-S2*a*-S2*b*-stretch.

With the initial latched rotation of S2, the left shoulder joint rotates about the S2 rotation axis, in turn pulling on the left arm. The direction of this pull is out-of-line with the centre of mass of the S3-S4 segment combination, and the pulling force causes or assists S3-S4 in commencing movement which quickly develops into arced movement in a plane which is commonly referred to as the swing plane. This represents the commencement of transfer of kinetic energy to S3 and S4 by sling transfer. As the swinging motion progresses, the pulling force remains out-of-line with the centre of mass, and continues to accelerate the S3-S4 combination in arced motion, with the club head at its distal end. Because of the difference in radius lengths about their respective axes of rotation, there is an advantageous magnifying effect between the speeds of the left shoulder and the club head distal end.

This swinging motion in the swing plane is also powered by local energy at the shoulder in rotating the arms segment about the left shoulder joint. The compound movement of the S3-S4 segments about the nearer-to-vertical S2 rotational axis and the nearer-to-horizontal left shoulder rotational axis provides the appropriate angular movement in the inclined swing plane. This provides a further integral component of the swing mechanism.

While the swing progresses and the club head achieves greater speed, local energy is used to launch the S2 segment off the S1 segment, gradually unlatching their movements in the process. This activity comprises a generation of local energy and is powered by muscles, associated with the joint between S1 and S2, and is capable of producing greater angular speeds than could be achieved with these segments latched. This continues to power the swing transfer mechanism at ever increasing speeds.

Through these first stages of the downswing, S4 remains latched to S3, with the angle between the lower arm and club shaft typically maintained by the player at an angle of about 60° to 70°. The player then unlatches S3-S4, approximately around DS170°-DS135°, whereupon kinetic energy commences transfer by the flail mechanism. At the time of unlatching, the S3-S4 combination is rotating at high speed about the left shoulder joint, with high centrifugal forces generated. These forces rapidly open the now-unlatched angle between S3 and S4, causing increased acceleration of the distal end of S4 and deceleration of its proximal end. Total energy is substantially conserved and kinetic energy is transferred from the decelerating arms and hands to the rapidly accelerating club head.

Like all unlatching actions, the S3-S4 unlatch occurs over a brief duration of time. The characteristics of the unlatching action are significant due to its importance in relation to the final development of club head speed. The S3-S4 rotary unlatching action is an adduction of the wrist and corresponds to the 'wrist un-cocking' action of coaching terminology.

S3 continues to rotate through to impact, continuing to be powered by its own local energy after the S3-S4 unlatch.

Following the unlatching of S4 from S3, the player will usually power rotation of S4 with local energy from the muscles associated with the S3-S4 joint, i.e. primarily the muscles associated with the elbow and wrist joints. This will also cause a launch transfer of energy to occur from S3 to S4.

In a shot requiring maximum distance, the player will strive to match maximum club head speed with time of impact. This poses particular difficulties because the wrist joint is typically unable to power the wrist action at the high speeds typical for accomplished players approaching the point of impact. The accomplished player will advantageously utilise strain energy in the club shaft, developed during the more highly accelerated parts of the downswing. Part of this strain energy is released, with a straightening of the shaft, as the club head reduces its rate of acceleration due to the fall off S4 local energy, although still positively accelerating, just prior to impact.

Specific Aspects of Optimised Swings

The manner in which the backswing is executed and reversed to downswing is important in setting up optimal energy-parameter characteristics. In particular, the segments should be wound tightly on the backswing, within the constraints of setting up the correct position, maintaining control and avoiding risk of injury.

This provides the following benefits:

i) It allows the downswing latches to commence with minimal muscle support, the linking between segments being largely mechanically passive.

ii) It maximises stretch-shortening in the backswing, minimising the amount required in the early downswing.

iii) It maximises potential energy stored in elastic deflection, allowing this to be recovered in the downswing.

iv) It hastens the length of time it takes the downswing to get underway, providing more time and opportunity to optimise other aspects of the downswing chain.

Factors which facilitate such winding of the segments include the following:

i) Segments should attain sufficient angular speed and associated kinetic energy in the backswing to adequately power the wind-up of segments.

ii) Segments should complete their rotational wind-up in the time sequence S1, S2, S3 and S4. This facilitates each successive wind-up in holding or tightening the previous wind-ups. Any segment completing its wind-up out of sequence may lead to loosening of the wind-up of the previous wound-up segment.

iii) Each TOB should be completed smoothly and sharply, and rapidly reverse in the opposite rotation.

The downswing commences with rotation of S1 at TOB-1, with segments S2, S3 and S4 latched to it in-chain at the earliest possible opportunity, that is at TOB-2, TOB-3 and TOB-4, respectively. This early low-speed stage of the downswing enables full use of the relatively slow but powerful S1 local muscle group.

It is established in prior art biomechanics that the S1 local muscle group is capable of advantageously increasing the degree of stretch-shortening of the S2 local muscle group in the beginning stages of the downswing. This further stretch-shortening is over and above that which is possible and feasible on the backswing and should be executed in the optimal swing. Although of less importance, it can also be advantageously executed during the equivalent beginning stages of the S3 and S4 latches. These downswing stretch-shortening processes have the particular advantage that they use the relatively slow-acting S1 local muscle group to power the initial stretch-shortening of all the distal segments, and subsequently realise the additional energies in the faster-acting distal segment muscles.

Latching provides a highly advantageous method of transferring energy in the early stages of the swing and should be commenced as early as possible for each segment, with due allowance for stretch-shortening physiological requirements, that is with segments S2, S3 and S4 latched in chain sequence to S1. The advantages of early latching include:

(a) It promotes an extremely efficient transfer of energy up through the chain.

(b) It entails no work or muscle displacement within the instant segment, and can be continually used without dissipation of muscle range within that segment.

(c) It maintains muscles in the beginning-of-range positions, until their displacement is required in the other modes of the intermediate segment movements.

Several efficiency factors come into play when a segment is launched from its neighbouring proximal segment.

A first efficiency factor concerns the rate of local work required to execute the launch. Taken in isolation, the launch is most efficiently executed if the immediate segment delays its launch until the proximal segment completes its acceleration stage in the same direction or rotation. This can be demonstrated where the instant segment has a mass $M_I$ and is required during launch to be linearly accelerated away from the proximal segment at an acceleration $A_I$. If the proximal segment has completed its acceleration stage and is moving at constant velocity together with the latched instant segment, the force required by the local muscles to execute launch is $M_I.A_I$. However, if launch is attempted when the proximal segment is still accelerating at a rate $A_P$, the force required by the local muscles will be considerable greater at $M_I.(A_I+A_P)$. A similar situation exists where the movements are rotary.

A second efficiency factor concerns energy transfers between the two segments. When local energy is used to launch an instant segment off a proximal segment, momentum is transferred to the proximal segment, since total momentum is conserved. Kinetic energy is typically transferred between segments when this occurs, the direction of transfer depending on the velocities of the segments. The effects of momentum and kinetic energy transfer can be quite different, due to momentum being proportional to velocity and kinetic energy being proportional to the square of velocity. Energy will disadvantageously transfer to the proximal segment if the proximal segment is at rest when launch commences. However, energy will advantageously transfer from the proximal segment to the instant segment if the proximal segment is moving in the launch direction throughout the duration of launch. The greater the velocity of the proximal segment, the greater will be the transfer of energy to the instant segment. Therefore launch transfer of energy from the proximal segment is maximised when the proximal segment is at its maximum speed. Launch transfer occurs both for rotary and linear motion.

A third efficiency factor concerns the quality of the latch, in that as soon as launch commences, the instant segment will move at greater speed than the proximal segment and the latch can no longer maintain its original passive mechanical linkage, requiring muscle activation to support the linkage. Indeed, in certain cases the latch may no longer be capable of operating effectively or at all, particularly in the case of the S1-S2 rotary latch, where rotation of both segments occurs around similarly positioned and inclined axes.

In view of these factors, it is evident, where all other things are equal, that in an optimal swing, the proximal segment should accelerate to peak speed as quickly as possible and launch of the instant segment should only commence after the proximal segment has completed this acceleration and reached peak speed. Also, since a general principal in the operation of the kinetic chain is to complete all actions without unnecessary delays, ideally together or tightly in sequence, unlatching and launch should occur as soon as the proximal segment reaches peak proximal segment speed.

It can be observed from the above that in an optimal swing, where all other things are equal, segments will attain maximum speed in the time sequence S1, S2, S3 and S4.

In addition to the generation of momentum and kinetic energy about the principal swing axis, the player also generates significant components of angular and translational momentum and kinetic energy, substantially in the frontal plane. This includes segment rotations about horizontal axes perpendicular to the frontal plane and segment linear movements parallel to the frontal plane. This energy and transmission will be referred to as 'auxiliary-frontal-plane' energy generation and transmission and bears some relationship to the processes referred to as 'weight shift' in coaching terminology. The 'frontal plane' is defined as a vertical plane aligned with the target direction.

The auxiliary-frontal-plane motions are essentially compounded with the main swing angular movements and, in the four segment model, are also powered by the same local muscle groups.

The auxiliary-frontal-plane energy differs from the main swing energy in that it can be generated and transferred in fundamentally different ways by accomplished players. Tests have indicated at least three distinct techniques used by accomplished players in generating and transmitting this additional proximal energy. About 50% of swings have been found to use a distinct technique which will be referred to as type 'A'. About 40% use a distinctly different technique which will be referred to as type 'B'. The balance use one or more other distinctly different techniques, which will be collectively referred to as type 'C'. Insufficient test information has been available to analyse type C in detail, and discussion in this specification shall be limited to the more frequently encountered types A and B.

It was observed in tests that most players solely use one technique but that a minority occasionally switch between type A and B swings. Accordingly, the technique is more accurately considered a swing rather than a player characteristic. It was also observed that types A and B appear to exist in fairly similar proportions across different player skills, ranging from professional players to high handicapped amateurs, indicating that both techniques may be considered similarly accomplished. It was further observed that the two techniques cannot be mixed in an individual accomplished swing, between these two types the accomplished technique will either be type A or type B.

Although not yet conclusively proven, it appears that type A comprises a combination of rotation and translation which is largely in the frontal plane, at all times in the target direction. Type B also appears to comprise a combination of rotation and translation which is largely in the frontal plane, but in this instance commencing with all segments in the target direction, and then switches to a flail type action of one of the segments, again largely in the frontal plane, with its proximal end decelerated to increase the acceleration of its distal end.

Although the high speed compound nature of these movements are difficult to visualise, their effects show very clearly in measured ground-reaction forces, where the resultant vertical down force, commonly referred to as the centre-of-pressure, or COP, is observed to move strongly in the direction of the frontal plane, either to or away from the target.

Accomplished swings, which use the type A technique, commence with a linear movement of the COP to the right, away from the target, reversing at some point between about BS180° to DS180° to a longer linear movement of these segments left towards the target, continuing to impact. The linear movements are partly independent of the swing angular positions. Testing indicates that type A technique develops greater energy generation and transfer when the COP displays greater linear acceleration and velocity towards the target in the longer movement towards the target, and also where the length of this linear movement towards the target is increased.

Accomplished swings, which use the type B technique, commence with a similar linear movement of the COP to the right, away from the target, again reversing at some point between about BS180° to DS180° to a linear movement left towards the target, but over a much shorter distance than occurs with type A. The linear movement then reverses again to the right away from the target, continuing to impact. This second reversal usually occurs at about DS180°, although this can occur before DS180° or almost as late as DS90°. The various linear movements appear to be less independent of swing angular positions, than is the case with type A swings. Tests indicate that type B technique develops greater energy generation and transfer when its COP displays greater linear acceleration and velocity towards the target in the second linear movement, which is towards the target, and also in the third linear movement, which is away from the target. This appears to be of particular importance at the early stages of this third linear movement. The lengths over which these accelerations are applied on the second and third strokes is also of relevance to generating and transmitting greater amounts of energy.

The player can control several aspects of operation of the S3-S4 flail, including setting the initial latch angle between S3 and S4, and maintaining this latch angle to the time of unlatching. As the downswing progresses, this necessitates resisting inertia forces which at first try to pull S4 inwards and then later centrifugal forces which try to pull S4 outwards. The player should delay the unlatching point beyond the commencement of these outward pulling centrifugal forces. Following unlatching, the player should continue to directly power S3 and S4 with their local energies. The correct combination of these variables can vary between players, and will be the combination which causes the club shaft to attain maximum speed a little before impact and the club head to attain maximum speed just at the point of impact. An incorrect combination will typically cause maximum potential club head speed to occur too early or too late. Maximum 'potential' club head speed refers to the maximum which would occur if the ball was not decelerated by impact.

The four muscle groups associated with the four segments of the simplified model, in practice comprise a much larger number of muscles, which act in a multitude of ways and with a multitude of ranges of motion. When viewed as the four simplified groups, analysis can be simplified to the following. Each muscle group acts upon its associated segment to provide forces which give rise to angular and linear acceleration of the segment. Work is done as the forces displace the segments, with energy generated appearing as rotary and linear kinetic energy in the segment. Usually the muscle action will do most work and produce most energy for transfer up the chain, by sustaining the maximum force over the maximum range of motion.

Mechanically efficient movement is important in the acceleration of the segments. Displacements and velocities should change smoothly and be correctly directed.

In accomplished swings, for players of average body type, the S1, S2, S3 and S4 muscle groups will contribute about 30-35%, 40-45%, 15-20% and 5-8% of the original local energy used to power the swing.

Local Energies and Energy Sequence Rules

Tests have shown that increasingly accomplished play more closely follows the general latching and launching rules. The local muscle group remains at a low-level of activation until the instant segment unlatches from and launches off the proximal segment, whereupon it ramps up to and maintains a relatively high level of activation. This is ended and the local muscle ramps back down to the low-level of activation as the distal segment unlatches from and launches off the instant segment.

Tests have also indicated that professional or scratch players will usually follow these rules on all segments except S3, where in accomplished play the S3 muscle group continues activation after the S4 segment unlatches. This compromise of the rules appears to result from the relatively long range of motion of the S3 group in the downswing and from its relative strength compared to the weaker S4 muscle group. Tests have also shown that high handicap players typically do not conform to the rules over most of their downswing, overlapping the activations of the different muscle groups. Accomplished play displays rapid ramping up to high levels of activation followed by rapid ramping down as the distal segment enters the sequence. Poorly accomplished play typically displays lower levels of activation maintained over longer durations, overlapping the activations of the proximal and distal muscle groups.

For accomplished players, the S1 muscle group activates from TOB-4 and may typically remain at the ramped up activation for very roughly about 100 ms. The S2 muscle group will ramp up as that of S1 ramps down, and may typically remain at the ramped up level for very roughly about 70 ms. Similarly, the S3 muscle group will ramp up as that of S2 ramps down, and may typically remain at the ramped up level for very roughly about 80 ms. The S4 muscle group will ramp up while S3 remain active, and may typically remain at the ramped up level for very roughly about 20 ms.

The muscles within the sub-segments of the S2 segment effectively latch and launch off each other, with the muscles of the upper trunk being flexibly supported further along the chain than the muscles of the lower trunk. The muscles within the S3 segment comprise the muscle groups of the shoulders and elbows, with the left elbow further along the chain that the left shoulder and the right elbow further along than the right elbow. These sets of supporting sub-segments are subject to the same latching and launching conditions and rules, and in an accomplished swing the muscle group of the proximal sub-segment should complete its activation before that of the muscle group of the distal sub-segment. This sequencing of sub-segments is desirable. It is usually present in the swings of pro and scratch players and is usually absent in those of high-handicap players.

Tests indicate that the sequence is not usually present in the sub-segments of S1. This appears to be due to the dominant position of the powerful muscles of the hip-pelvis region which, although most distal in the chain of sub-segments from the ground to pelvis, are active from the initiation of downswing.

For each muscle group activation, the most efficient use or maximum amount of power and energy will be delivered to the system by it ramping up to its high level as quickly as possible, maintaining as high a level as possible over the available optimal segment displacement, and then ramping down again as rapidly as possible. Energy generation occurs as work is done, which necessitates displacement of the forces produced by the muscles. This displacement occurs as segment movement. Although segment movement is related to the length of time the muscles remains activated at the high level, the important variables in local energy generation are muscle group force and segment displacement at the ramped-up level rather than time at the ramped-up level.

It will be appreciated from the foregoing that the downswing from TOB-1 to impact comprises a highly critical sequence of energy generation activities which must be executed very precisely if maximum energy is to be generated and transferred to the club head. Any delays in the sequencing will either cause breaches of the latching rule or will subtract from the amount of time at which muscle forces can be applied to displace the segments. Identification and understanding of this energy sequence is key to the scientific analysis and improvement of the golf swing.

It is noted that the identification of latching, latching rules and energy sequencing rules for optimum energy generation and transfer, are new discoveries accompanying the invention.

It is also noted that several prior art biomechanics studies have observed that segment velocities frequently peak in a proximal-to-distal sequence in accomplished golf swings, although none appear to have been able to offer any cogent reason as to why this should be the case. Some prior art coaching methods have attempted to make use of this observation, but encounter the difficulty that it is only a side effect of one aspect of the fundamental underlying mechanics, and that some unaccomplished swings display a proximal-to-distal velocity sequence, while some relatively accomplished swings do not. However, it is clear from the present discoveries that the key underlying sequence is the energy generation sequence and the reasons for this partly arise from latching and launching consideration. A proper understanding of the overall underlying mechanics is essential for proper analysis and improvement.

Figure 4:
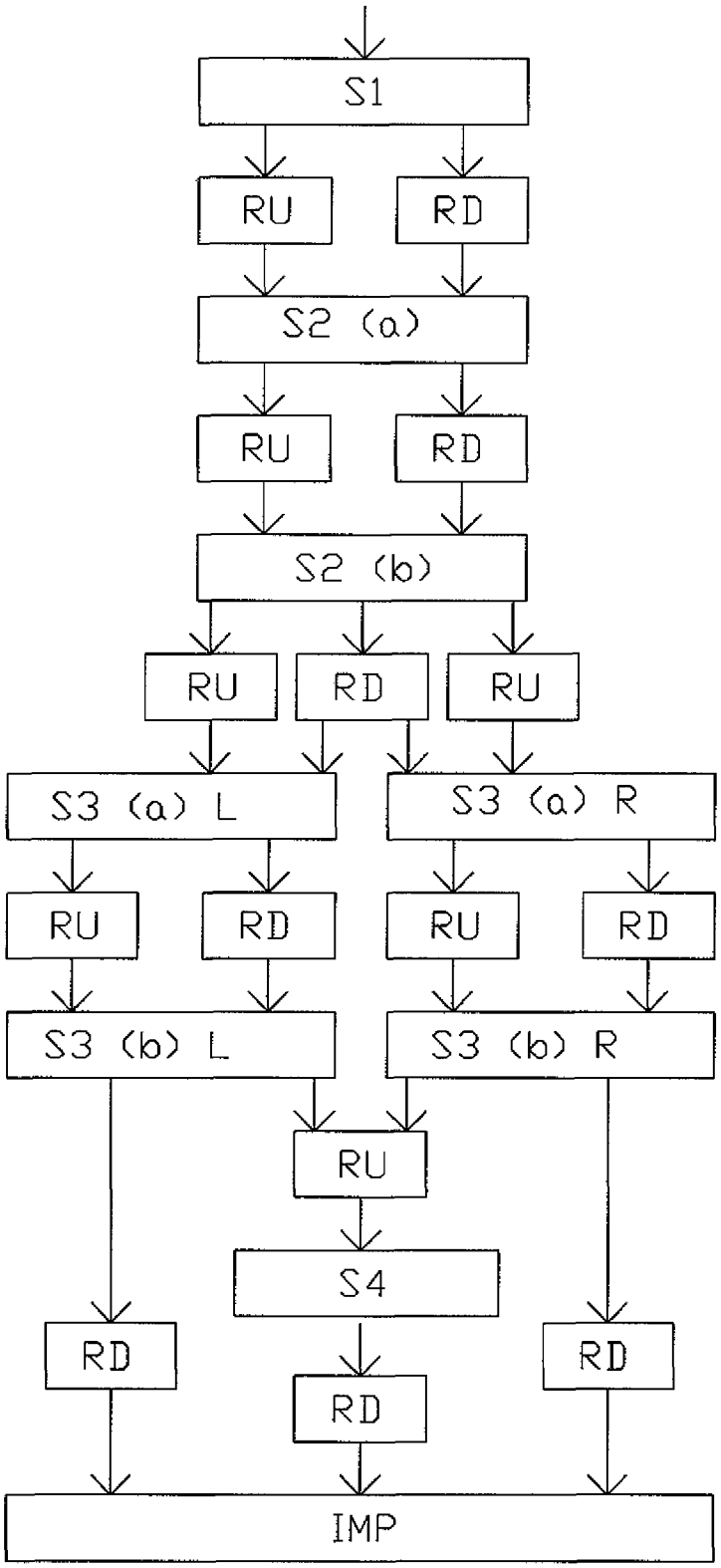
FIG. 4 is a block diagram showing sequential steps in detecting and processing information in a swing using an artificial intelligence means.

FIG. 4 is a block diagram showing these principal optimum local energy generation sequences in the downswing. The larger boxes represent periods of high level of local energy by the segment or sub-segment abbreviation marked on the box. Boxes marked 'RU' indicate a ramp-up, from a low to a high level of activation, of local energy of the segment or sub-segment shown in the following box. Boxes marked 'RD' indicate a ramp-down, from a high to a low level of activation, of local energy of the segment or sub-segment shown in the preceding box. The final box marked 'IMP' refers to the impact event. Tests have shown that this perhaps surprisingly complicated sequence of local muscles activations is largely achieved by a majority of very accomplished players. Furthermore, it is achieved within a swing downtime of little more than half a second. Very little of the distinct sequencing is achieved by high-handicapped players.

SUMMARY OF ENERGY-PARAMETERS, OPTIMISING-RULES AND OPTIMAL SEQUENCES

Energy-parameters discussed over earlier paragraphs are summarised in the following list:

- Start and completion times of segment and sub-segment local energy/forces ramp-ups.
- Start and completion times of segment and sub-segment local energy/forces ramp-downs.
- Magnitudes and durations of segment and sub-segment local energy/forces activations, including average and peak values.
- Times and transition characteristics of latching between connecting segments.
- Times and transition characteristics of unlatching between connecting segments.
- Segment linear and angular kinetic energy levels and times of peak values.
- Angular positions, velocities and accelerations of body and club segments through the swing, including peak velocities and accelerations, due to displacement by the local muscle group.
- Linear positions, velocities and accelerations of body and club segments through the swing, including peak velocities and accelerations, due to displacement by the local muscle group.
- Absolute angular positions, velocities and accelerations of body and club segments through the swing, including peak velocities and accelerations.
- Absolute linear positions, velocities and accelerations of body and club segments through the swing, including peak velocities and accelerations.
- Absolute speeds of body ands club segments, including club head absolute speed.
- Angular positions, velocities and accelerations between the trunk and arm segments and between the arm and club segments.
- Times and transition characteristics of top-of-backswing events for body and club segments.
- Magnitudes of angles between the various connecting segments at top-of-backswing events.
- Times of maximum muscle stretch-shortening between the various connecting segments.
- Magnitudes of angles between the various connecting segments at times of maximum muscle stretch-shortening between those segments.
- Latch Transfer of kinetic energy, defined as a transfer from one segment to another along the chain is by latching the instant segment to an accelerating proximal segment, such that the instant segment is accelerated along with the proximal segment by energy which is generated at, or existing at, the proximal segment.
- Launch Transfer of kinetic energy, defined as a transfer from a proximal segment to an instant segment, where momentum is exchanged and kinetic energy is transferred when the local energy of the instant segment is used to launch the instant segment off the proximal segment.
- Sling Transfer of kinetic energy, defined as a transfer by forces translating or rotating the target-side shoulder joint and slinging the distal segments in an arc which accelerates the distal portions.
- Flail Transfer of kinetic energy, defined as a transfer to the most distal end of the existing kinetic energy in two connected segments which are rotating and translating in the same direction, where the proximal segment and the proximal end of the distal segment are decelerated by centrifugal forces acting on the segments.
- Radius-reduction transfer of kinetic energy. where the rotating player reduces the angular moment of inertia of the body by reducing the effective radius of rotation, causing acceleration of the more distal parts.
- Development of potential gravitational energy on the backswing and early downswing.
- Conversion of potential gravitational energy to kinetic energy on the downswing.
- Development of club shaft potential strain energy on the downswing.
- Conversion of club shaft potential strain energy to kinetic energy on the downswing.
- Category of auxiliary frontal plane energy generation and transfer.
- Characteristics of auxiliary frontal plane energy generation and transfer.

Centre-of-pressure positions, velocities, accelerations and range of movement in relation to frontal plane energy-parameters.

Optimising-rules discussed over earlier paragraphs are summarised in the following list:

Segments and sub-segments should attain sufficient angular speed and associated kinetic energy in the backswing to tightly wind-up the segments in their top-of-backswing positions, with the segments being wound-up in the time sequence of proximal-to-distal.

The sequenced wind-up of segments and sub-segments should be smooth and co-ordinated.

The degree of wind-up between connecting segments and sub-segments should be such as to provide optimum stretch-shortening of all local muscle groups, and also optimum elastic stretching of relevant body parts.

As they attain the top-of-backswing positions, each segment and sub-segment should change rapidly from backswing to downswing rotation.

Downswing commences with the most-proximal segment powered by its local muscle group.

The most-proximal segment local muscle group should ramp up to a higher level of activation as rapidly as possible.

All other segments and sub-segments commence their downswing motions, commencing from their top-of-backswing positions, latched in proximal-to-distal chain formation to the most-proximal segment, with all powered by the most-proximal segment local muscle group.

As the segments and sub-segments commence their downswing motions latched in chain formation to the most-proximal segment, the local muscle groups of these segments and sub-segments, distal to the most-proximal segment, are optimally further stretch-shortened and elastically stretched. This further optimum stretch shortening and elastic stretching is completed when each segment or sub-segment attains the same speed as its proximal neighbour in the chain.

Other that where the local muscle group of a segment or sub-segment is significantly more powerful than its distal neighbour, a segment or sub-segment should end its principal local energy generation before the distal segment is launched from it.

Consequently, the distal segment or sub-segment will only launch after its proximal neighbour has attaining maximum speed.

A segment or sub-segment should unlatch from its proximal neighbour before launching from it.

The local muscle group of each segment and sub-segment should remain at a low-level of activation until the instant segment unlatches from and launches off the proximal segment, whereupon it ramps up to and maintains a higher level of activation. (In the case of the muscle group of the most proximal segment, this of course commences from the start of downswing). This is ended and the local muscle ramps back down to a low-level of activation as the distal segment unlatches from and launches off the instant. The rule exception is that the arm segment muscle group continues activation after the club segment unlatches, due to the muscle group of the arm segment being significantly more powerful than that of the club segment.

Local muscle groups of segments and sub-segments should ramp-up and ramp-down, between higher and lower activation levels, as rapidly as possible.

When it ramps-up to the higher levels of activation, the muscle group of each segment and sub-segment should maintain the higher optimum level of activation to accelerate the segment to the required maximum velocity as quickly as possible. The muscle group should ramp-down to the lower level as rapidly as possible after the segment attains the required maximum velocity.

The levels of energy activation and required segment velocities should be varied with the requirements of the swing. They should be optimally maximised for swings requiring maximum club head speed, and optimally reduced where lower club head speeds are required.

Segment and sub-segment motions should proceed smoothly and with optimum mechanical efficiency. Linear motions should be in the optimum mechanically efficient directions and angular motions should occur about optimum mechanically efficient axes.

An optimal latch angle should be set between the arm and club segments at the commencement of downswing of these segments, which promotes optimal flail energy transfer between these segments when they unlatch later in the downswing. This angle may lie between 60° and 70°.

An optimum latch angle between the arm and club segments is maintained to the point in the downswing where unlatching causes the club head to subsequently maximise its speed and to attain this maximum speed at impact.

For swings requiring high club head speeds, an optimum latch angle between the arm and club segments is maintained to the point in the downswing where unlatching causes the club segment to attain maximum angular speed shortly before impact, allowing released strain energy from the deflected club shaft to accelerate the club head to subsequently maximise its speed and to attain this maximum speed at impact.

Auxiliary-frontal-plane energy generation and transfer should be categorised as one of several types which do not intermix. Tests indicate there to be one most common type, one moderately common type and at least one other uncommon type. The moderately common type displays a reversal in centre-of-pressure linear movement away from the target direction, which is absent for the common type.

In the common type of auxiliary-frontal-plane energy generation and transfer without the centre-of-pressure reversal, where swings require maximum club head speed, the player should move such that his or her centre-of-pressure in the target direction is maximised in its length of linear movement and is maximised in its linear speed.

In the common type of auxiliary-frontal-plane energy generation and transfer with the centre-of-pressure reversal, where swings require maximum club head speed, the player should move such that his or her centre-of-pressure trace is first maximised in linear speed in the target direction, and is then maximised in linear speed away from the target direction.

It is noted that many of the individual optimising-rules comprise new discoveries accompanying the invention, particularly those related to energy generation sequencing, latching and launching. Continuing research and testing may give rise to additional rules, or instigate revision of some of those currently listed. They are also envisaged in the refinement of comprehensive listings of energy-parameters and optimising-rules.

Various energy-parameters and related events for a typical optimum swing are shown in a single sequence below, alongside a reference framework of club shaft angular positions and typical times at which they occur. These times are shown in parentheses as seconds before impact and seconds after impact. Auxiliary-frontal-plane energy-parameters are not included in the sequence as they vary for different types of swing and also vary in their positions within the club shaft angular position framework, as described previously.

The sequence represents an idealised swing. The abbreviation 'CH' refers to the club head. 'S2*a*' and 'S2*b*' refer to the local muscle groups associated with the lower and upper sub-segments of S2. 'S3*a*' and 'S3*b*' refer to the shoulder and elbow local muscle groups associated with the sub-segments of S3. Note that although shown together in the sequence, the left and right arm sets of sub-segments have separate sequence movements.

1. BS90° (−0.728 s)
2. BS135° (−0.613 s)
3. BS180° (−0.541 s)
4. TOB-1
   S1 local energy ramps up
5. TOB-2
   S1-S2 rotary latch commences
6. TOB-3
   S1-S2-S3 rotary latch commences
7. TOB-4 (−0.271 s)
   S1-S2-S3-S4 rotary latch commences
8. S1-S2-stretch
   S1-S2 rotary latch fully wound
9. S2-S3-stretch
   S1-S2-S3 rotary latch fully wound
10. S3-S4-stretch
    S1-S2-S3-S4 rotary latch fully wound
11. Maximum angular speed S1
12. S1-S2 rotary latch ends
    S1 local energy ramps down
    S2*a* local energy ramps up
    Launch transfer of energy from S1 to S2*a*
13. S2*a*-S2*b* rotary latch ends
    S2*b* local energy ramps up
    S2*a* local energy ramps down
    Launch transfer of energy from S2*a* to S2*b*
14. Maximum angular speed S2*b*
15. S2*b*-S3*a* rotary latch ends
    S2*b* local energy ramps down
    S3*a* local energy ramps up
    Launch transfer of energy from S2*b* to S3*a*
16. DS180° (−0.100 s)
17. Maximum angular speed S3*a*
    S3*b* local energy ramps up
    S3*a* local energy ramps down
    Launch transfer of energy from S3*a* to S3*b*
18. S3*b*-S4 rotary latch ends
    Flail transfer to S4 and CH commences
    S3 commences deceleration
    Launch transfer of energy from S3 to S4
    S4 local energy ramps up
19. DS135° (−0.072 s)
20. DS90° (−0.047 s)
    S3*b* local energy ramps down
21. DS45° (−0.018 s)
22. S4 local energy ramps down
23. Maximum angular speed S4
    Shaft strain energy transfers to CH
24. Max absolute speed CH
    Impact (0.000 s)
25. FT45° (+) (+0.028 s)

Measurement

In a preferred embodiment of the invention, a swing is measured or detected by a system or apparatus, and its energy-parameters are measured or calculated.

There are various methods known in the prior art which can be used to measure body and club movements associated with a golf swing including movements of body segments or joints. The most successful and commonly used methods of this type are optical motion capture systems and electromagnetic motion capture systems.

In a typical optical motion capture system, passive reflective targets are fitted at critical points on a player's body and club. The positions of these targets are tracked through the swing, using multiple high speed cameras which view the player from different positions. The system has two particular advantages. It has high accuracy and the targets are light and unobtrusive for the player. It also has several disadvantages, which include the following. The equipment is very expensive. Set-up is onerous. It is not capable of real time operation and thus cannot be used interactively. Its optical sensitivity prevents outdoor use. Problems can arise from targets being obscured from view or confused in crossover.

In a typical electromagnetic motion capture system, the player is fitted with active sensors at critical points of the body and club. The positions and orientations of these sensors are tracked, through the swing, in a reference electromagnetic field generated by a transmitter. In one version of the system, the sensors are connecting by wires to a remote computer. In an alternative version, the sensors are connected wirelessly. The system has some advantages relative to the optical motion capture system. It is not optically sensitive and can be used outdoors. It is capable of real time operation. The sensors are not subject to the possibility of being obscured from view or confused in crossover. Although the equipment is expensive, it is significantly less expensive than the optical type. The system also has some disadvantages relative to the optical type. The sensors are obtrusive for the player and may affect the swing, particularly in the case of the wire-connected version. The wireless targets require a power source which may need to be replaced or recharged. The system is less accurate, particularly in the case of the wireless version. Signal interference problems may be experienced with metal clubs. It is not usually capable of accurately measuring very fast swings.

Both the optical system and the electromagnetic systems share the following disadvantages. They can only be operated by skilled personnel. Targets may be fitted incorrectly or inconsistently on the player or club. Targets necessitate time and effort in being fitted and removed. Targets need to be fitted to all clubs used with the system.

Other motion capture systems are known in the prior art, including ones utilising sensors comprising accelerometers or gyroscopes mounted on the player and club. The most successful of these have similarities to the electromagnetic system described above and have similar advantages and disadvantages.

All of these systems share a further disadvantage in that they are confined to measurement of body movements. Further means are required to measure forces, work done or work generated. One such means involves use of an appropriately programmed computer to model forces and work within the body, by ascribing masses and moments of inertia to the body segments and club and using body and club motions measured by the motion capture system to drive the joints and segments of the model. The computer analyses the motion and determines the relevant forces and work. These systems require considerable technical expertise on the part of the user and are very unlikely to be suited for use by coaches or players. These systems are known in the prior art and shall be termed 'computer android models' elsewhere in this specification and in the claims.

The invention provides a method and apparatus which overcomes the various disadvantages of prior art measurement apparatus set out above.

Although not normally associated with body segment measurement, information related to body movement and forces, can also be obtained from measured ground-reaction forces. There are various devices known in the prior art which measure ground-reaction forces, including insole pressure pads, standing mat pressure pads and single or double rigid standing platforms, sometimes referred to as force plates. Pressure pads typically comprise a matrix of a large number of miniature force/pressure sensors. They are usually only operable to measure vertical ground-reaction forces.

Force plates typically comprise rigid rectangular platforms with force sensors positioned under the corner regions. They are commonly used to analyse balance and gait in medical or sports applications. The sensors are usually of the strain gauge, piezoelectric, capacitance or piezoresistive types. Force plates typically comprise one or two platforms. Where two platforms are used, the subject places one foot on each. Force plates typically measure either vertical forces, or forces in all three XYZ directions in three-dimensional space, that is vertical and side forces.

U.S. Pat. No. 7,406,386 discloses a device which is said to be useful for a very wide range of pressure sensing applications, ranging from mouse pointing pads to standing surfaces which are capable of measuring ground-reaction forces. The device comprises a deliberately deformable surface with a plurality of sensors. The sensors detect local deformations or strains on the surface, and differ inherently from the load sensing sensors used in prior art pressure pads and force plates. The sensory data resulting from these local deformations or strains are collectively combined and collectively processed. A computer algorithm is used to process the collective inputs which arise from these deformations. Although the disclosure suggests a neural network as one of a range of possible types of algorithm, it is apparent from the disclosure that what is intended is a network which operates in a deterministic algorithmic manner rather than a network which operates with artificial intelligence. The disclosure appears to suggest use of the algorithm to carry out the task of mapping the deformation to a location on the surface, to provide a similar result to the way a force plate converts load signals to a centre-of-pressure location. The suggested use of this device as a means of measuring ground-reaction forces in competition with commercially available force plates is misplaced, since such measurements require a level of accuracy and consistency which could not be provided by the disclosed device. A device relying on the detection of surface deformations would be unsuitable for many reasons, including the large variations in inputs which would invariably occur both with changing ambient temperatures and with ageing and wear of the detecting surface.

Preferred Method And Apparatus

In a preferred embodiment of the invention, the apparatus primarily or solely obtains information on the swing from measured ground-reaction forces. In a first variation of this embodiment, vertical and side forces are measured and the apparatus comprises a twin platform force plate. In a second variation, only vertical forces are measured and the apparatus again comprises a twin platform force plate, although a high-speed pressure pad arrangement encompassing both feet may also be considered. The first variation has the relative advantage of higher accuracy. The second variation has the relative advantages of lower cost, simpler construction and potentially reduced weight and thickness.

Force plate analysis usually involves study of centre-of-pressure movement, equating this roughly with the easily understood concept of movement of centre of mass or centre of gravity. The centre-of-pressure on a force plate is the calculated point where the measured resultant force vector intersects the standing surface. Centre of mass approximately follows centre-of-pressure for most average human movements, although this is not the case for a high speed accomplished golf swing. Force plates with additional side force measurement are also commonly used to analyse torques, impacts and friction effects, all concepts which are readily understood. Beyond these largely subjective studies, which are amenable to interactive subjective intervention by a supervisor or expert, force plate signals are usually found too obscure or complex for meaningful or useful human analysis.

An aspect of the present invention comprises the insight that a great deal more useful information can be obtained from measured ground-reaction forces than can be obtained by conventional methods and that this also applies to the very rapid movements of the golf swing. More particularly, the present invention comprises the insight that measured ground-reaction forces include information related to energy generation and transmission in a golf swing and include the energy-parameters required for analysis a golf swing.

A further related aspect of the present invention comprises the insight that this useful information from measured ground-reaction forces can be extracted by using an artificial intelligence means in cooperation with a means which measures ground-reaction forces, such as a force plate or pressure pad. A related aspect of the invention comprises the insight that an artificial intelligence means will advantageously analyse measured ground-reaction forces where these are first processed into data which better characterises the swing.

Figure 5:
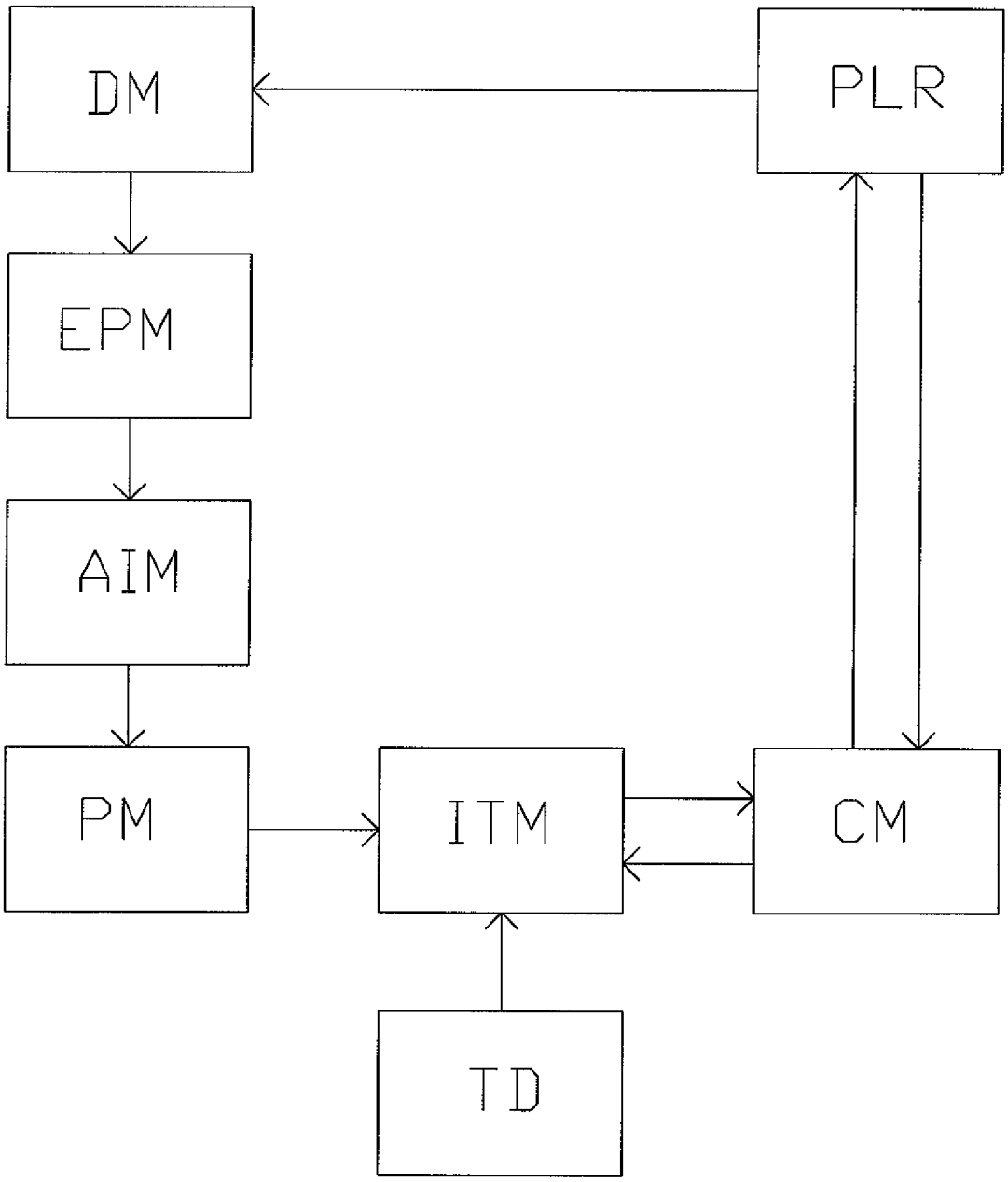
FIG. 5 is a block diagram showing information flow in a swing with interactive training.

FIG. 5 is a block diagram showing sequential steps in detecting and processing information in a swing using an artificial intelligence means. Descriptive abbreviations used in the figure are shown in parenthesis in the following brief description. Ground-reaction forces over the course of a swing (S) are detected by a detection means (DM). Information from the detection means is processed by an early-processing means (EPM), into data which better characterizes the swing. This data is received by an artificial intelligence means (AIM) which processes or determines energy-parameters of the swing. These energy-parameters are subsequently used to produce an analysis (A) of the swing.

Artificial intelligence, sometimes referred to as machine intelligence, comprises well established categories of data processing systems used in a manner resembling human intelligence, including artificial neural network systems, evolutionary computation systems and hybrid intelligent systems.

Artificial neural network systems, which will be referred to as neural networks or networks, are problem solving means, which can operate in a manner which has these similarities to human problem solving, although they are also sometimes used in a more deterministic manner. These similarities to human problem solving relate to use of previously learned experience from which a solution can be determined or interpolated when a new problem or situation arises. The neural network comprises an interconnected group of artificial neurons that uses a mathematical or computational model for information processing using a connection based approach. It involves a network of simple processing elements, or neurons, which can exhibit complex global behaviour, determined by the connections between the processing elements and element parameters. Information is stored as 'weights' between neurons. These weights are trained by presenting input and output patterns in a process of supervised learning.

In the preferred embodiment of the invention, a system of neural networks is used to extract relevant information from ground-reaction forces measured by a force plate.

Various neural network systems can be used. The following system was found to work well in executing the methods of the invention. The network system comprises a plurality of individual component networks. The typical component network comprises a conventional multi-layer feed-forward artificial neural network with backward propagation. It has a single hidden layer, with around 30 to 70 neurons, with about 50 appearing to be an optimum number. Tests indicate no significant increase in performance with greater numbers of neurons or hidden layers. Sigmoidal transfer functions are used for the input layer, to allow a large input range without becoming dominated by extreme values, and a linear transfer function for the hidden and output layers. Networks are trained with supervised learning with the process facilitated by established accelerated learning techniques. Over-fitting is prevented by choosing the smallest number of hidden neurons that yields good generalisation. The trained networks are tested on data that is completely independent from its training data.

Although trained networks can have multiple outputs and thus share predictions, in tests it is found that more accurate results are obtained with separate networks.

Data from a force plate is taken at a sample rate of about 300 Hz and processed into suitable inputs. The data is smoothed by conventional filtering techniques, such as an eleven point arithmetic moving average, before being fed to the trained network.

It is important to use a sufficiently large training sample to ensure that it covers the span of swing variations which may be encountered amongst those being measured. The sample is advantageously dominated by accomplished players to provide a core body of optimal energy-parameter elements, but high handicap players are also required to provide a wide error variation. Tests have shown that quite accurate network predictions can be obtained with training samples comprising as little as 50 different players, with each player sampled for about ten swings with each club type. Increasingly more accurate results are obtained with increasing sample size and commercially used system might ideally be trained on the swings of several hundred players. Although the networks will quite accurately predict swing characteristics of clubs which are of intermediate length to clubs on which the networks have been trained, for example predicting results of an 8-iron club using networks trained on 7-iron and 9-iron clubs, it has been found that improved accuracy is obtained by using dedicated networks for each club length. The additional processing memory and requirements to cater for these additional networks is well within the capabilities of modern low-cost electronic equipment.

Tests have shown that the system performs much more effectively when the raw signals from the force plate are pre-processed in a processor, or early-processing means, into data which better characterises the swing, prior to being presented to the networks. Examples of such early processing include the following:

a) Smoothing of the data stream, such as the use of an arithmetic moving average;
b) Scaling to ensure comparable reading between different sensors;
c) Temperature stabilising, to overcome errors from changing temperatures;
d) Voltage stabilising, to overcome errors from changing system voltages;
e) Conversion to COP X and Y positions on individual feet or across a combination of both feet;
f) Conversion to COP X and Y velocities on individual feet or across a combination of both feet; and
g) Conversion to COP X and Y accelerations on individual feet or across a combination of both feet.

This processing makes it much easier for the networks to understand the myriad and subtle overlapping streams of information which are inherent in the measured ground-reaction forces.

Determination and Calculation of Energy-Parameters

The following terms and conventions are used in the specification and accompanying claims to facilitate the description of methods used to extract the energy-parameters. As previously mentioned, parameters which directly relate to energy-parameters and which are obtained to calculate or determine energy-parameters, may also be termed 'energy-parameters'. Inputs and outputs used when training a network and when later making use of the network in predicting the parameters of new swings, may be referred to as 'training inputs' and 'training outputs', and 'application inputs' and 'application outputs', respectively. The term 'angular/linear' may be used to denote angular or linear, or angular and linear, as appropriate to the motion, since segments commonly display angular and linear motions. The chronological sequence of a variable with time across a swing, or part of a swing, may be referred to as a 'plot', since such information is usually presented as a plot or graph when subjected to human study. The term will sometimes be used for convenience where the information is not actually presented for human use in plot format but used in data form within the processor. Directions in three dimensions, relative to the golf swing may be referred to as 'X', 'Y' and 'Z' directions, with X representing the horizontal direction towards the target, Y representing the horizontal direction perpendicular to X, and Z representing the vertical direction.

Three separate network types are disclosed for extraction of energy-parameters from the force plate inputs. These network types will be referred to as 'time-series-prediction-networks', 'time-point-prediction-networks' and 'compressed-data-prediction-networks'. The data predicted by them shall similarly be referred to as 'time-series-predictions', 'time-point-predictions' and 'compressed-data-predictions'. They are separately described in the following paragraphs.

The time-series-prediction network is used to predict values of parameters which vary across the course of the swing. During training, all inputs are entered as normalised values and an output is registered, as each time point is sampled. The normalised value may for example represent the value as a proportion of the maximum value. When actual outputs are subsequently presented to the trained network, the network predicts a number against each set of inputs, and where training has been correctly carried out; the output will equal or approximate to that which was encountered during training in what the network determines to be the most relevant similar circumstances. This will typically result in a time-series plot, which will comprise some degree of 'noise', such that the plot comprises partly random side-to-side fluctuations along a general path approximating to the curve. The noise is subsequently removed or reduced by the processor, either by smoothing or by fitting a polynomial curve of a format which best conforms to the shapes which such actual curve are most likely to have, or by a combination of both. Too much smoothing may eliminate characteristics in the underlying outputs, whereas too little smoothing may fail to adequately eliminate noise. Tests have shown that smoothing provides very good results where the actual results progress smoothly along the plot or chronological series, but is less accurate where the plot or chronological series undergoes relatively sharp peaks or inflexions. Tests show that much better matching of predicted outputs, around peaks or inflexions, to actual outputs results from fitting the predicted outputs to a polynomial, such as a third order polynomial. Where specific portions of the curve are of interest, they may be separately fitted with such polynomials. For example, the peaks of curves may be separately fitted for values over 75% of maximum value.

Figure 16:
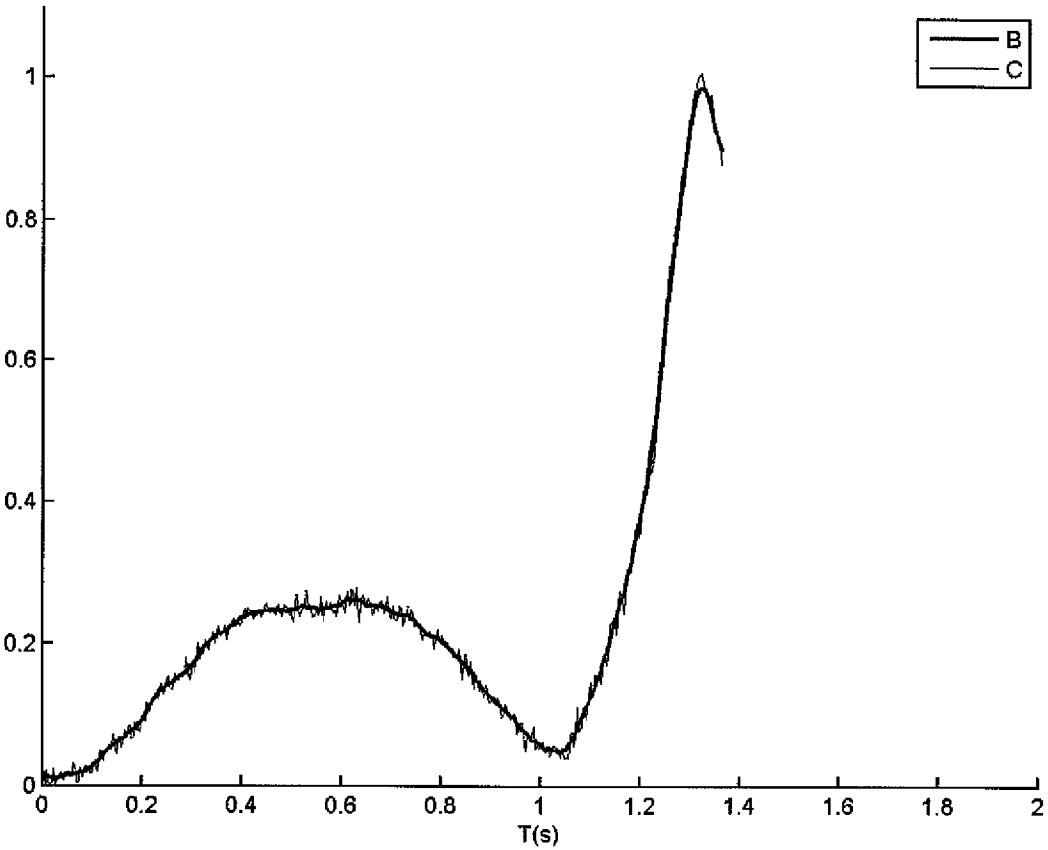
FIG. 16 shows a neural network raw prediction plot and corresponding smoothed prediction plot over the course of a swing.

Examples of typical time-series-predictions are shows as visual plots in FIG. 6 to FIG. 12. These are discussed in greater detail later in the specification. An example of a raw and smoothed prediction is shown in FIG. 16. The lighter jagged line C represents the raw prediction and the heavier line B represents the smoothed prediction. FIG. 16 shows actual results for predicted club head absolute speed over the course of a swing, with smoothing automatically executed by an electronic processor.

The time-point-prediction network is used to predict the time of swing events or parameters which can be defined as occurring at a point in time. During training, all inputs are entered and an output is registered as each time point is sampled. Since there is only one correct point answer, and small errors would be otherwise treated the same as large errors, a 'fuzzy' definition of the parameter is advantageously used. An example of this is a triangular weighting function. A weighting function with a peak of 1 and a width of 100 ms has been found suitable. The width of 100 ms provides an arbitrary balance between including sufficient data to maximise the training of the network and maintaining precision of the time of the parameter. The choice of 100 ms gives samples 25 ms away from the correct instant half the weight of samples at the correct instant for the parameter. Samples beyond 50 ms before or after the actual value of the parameter are given no weight. Alternative weighting functions include trapezoidal, Gaussian, bell and sigmoidal functions, although the triangular function was found to be marginally more accurate in the system described in this specification.

When actual outputs are subsequently presented to the trained network, the network predicts a number against each set of inputs, and the retained learning from the training phase causes the output to tend to generate values closer to unity as the time points under examination come closer to the actual time. This results in a series of predictions with some degree of 'noise'. This is smoothed with a moving average filter, for example an eleven figure moving average, with the time point represented by the arithmetic average of its own value and the value of the five predictions to either side of it. Where the network is properly adjusted, this typically results in a single clear maximum peak value, which is taken as the prediction for the parameter. If a parameter is found to produce predictions which are not clear cut, for example where there are occasional rival peaks or where a maximum peak does not represent a significantly central position above other lesser peaks which are skewed to one side, more sophisticated methods are used to determine the most likely value for the parameter.

Figure 17:
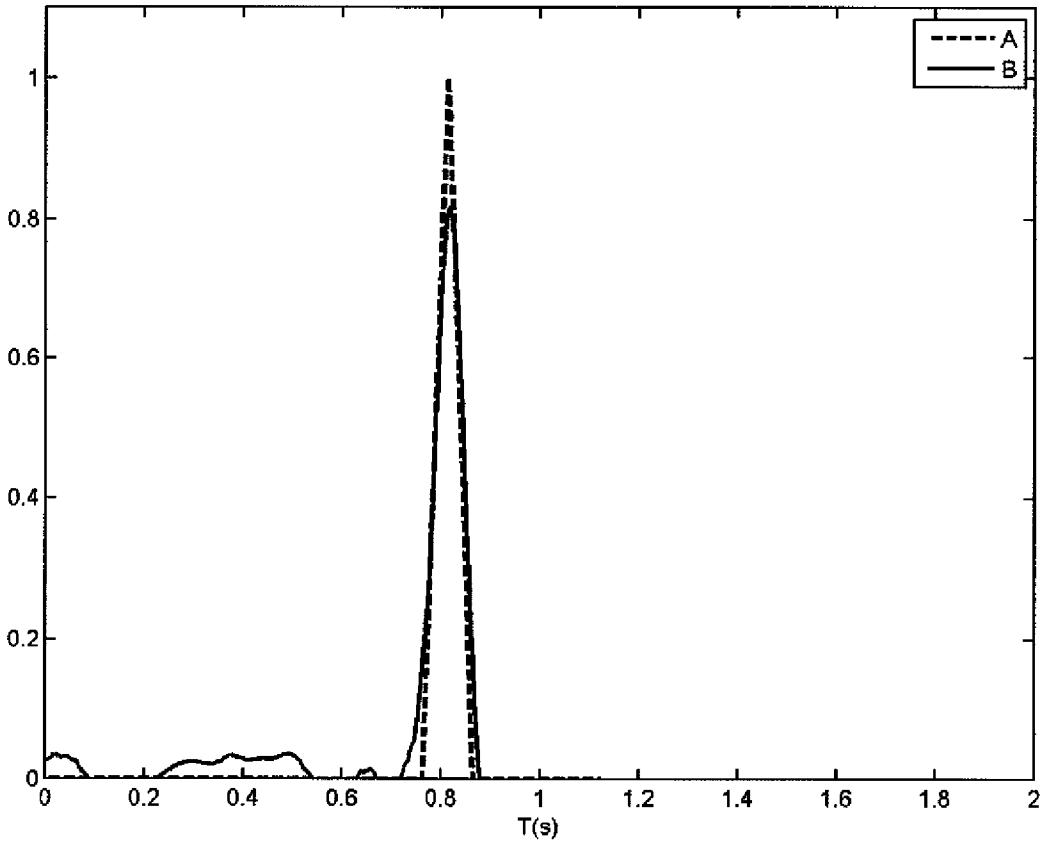
FIG. 17 shows a neural network time-point prediction of the time of club top-of-backswing and also shows a representation of the triangular weighting function used in making the prediction.

FIG. 17 shows a visual plot of a typical time-point-prediction of TOB-4 using the triangular weighting function described above. The dashed line A shows the form of the triangular function used in the training phase, with its apex set at the time of TOB-4 which is known for this swing from independent motion capture analysis. The solid line B shows the smoothed values predicted by the trained network. It can be seen that the prediction varies with time, but peaks strongly at a time point close to the actual time measured by motion capture analysis. The processor identifies the peak in line A and determines a single predicted value of time for the event.

The inputs to time-series-prediction and time-point-prediction networks are normalised, including times and angles. This can be done, for example, by assigning a value ranging from zero to unity, corresponding to the minimum and maximum values of the variables.

Usually it will be found that the timing of a specific point on a time-series-predicted curve can be more accurately predicted as a time-point prediction. For example, the time of TOB-4 can be more accurately predicted as a time-point-prediction than by seeking the extreme angular position of the club shaft at the top of the downswing using a time-series-prediction of the club shaft angle. This would be expected because the time-point-prediction network has its expertise directed at all matters concerned with the timing of TOB-4, whereas the time-series-prediction network has its expertise directed at predicting values which occur right across the swing. The results of both types can be combined to increase the overall accuracy of predicted results. An instance of this is afforded in the example just discussed. The timing of TOB-4, predicted by time-point-prediction can be used to more accurately adjust the timing of the peak in the time-series-predicted curve for club shaft angle. Similarly, the shape of the curve surrounding the predicted instant of TOB-4 can be used to better describe that event, for example whether it occurs as a sharp peak or as a flat slow-changing plateau.

The compressed-data-prediction network is used to predict parameters which require information broadly across the swing or portions of the swing, or if related to a specific time in the swing, also require significant information from other times in the swing. Examples of the former include categorising of the swing type or player type. Examples of the latter include prediction of the time of impact.

Where compressed-data-prediction is used, the inputs characterise aspects of the entire swing, or portions of a swing. For example the inputs may comprise a chronological spread of information from a force plate output or from a time-series-prediction of a parameter across a swing. A requirement for handling such information is to find some way in which the data can be conveniently compressed. An appropriate and well establish form of data compression is to represent such variables by mathematical functions, such as the coefficients of a Fourier series, with higher-order frequency terms discarded as appropriate, to form Fourier transforms. An alternative but similar technique is to use wavelet transforms. A wavelet transform is the representation of a function by wavelets, which are mathematical functions used to divide a given function or continuous time signal into different frequency components. Wavelet transforms can have advantages over traditional Fourier transforms in representing functions with discontinuities and sharp peaks. Suitable transforms, such as Fourier or wavelet transforms will be referred to simply as 'transforms' in the specification and appended claims.

A network is trained with the training transforms as training inputs and the training variable as training outputs. A trained network is then used to predict an application output against the application transform inputs. During training, the training inputs may comprise, for example, processed data from the force plate, and the corresponding training outputs may comprise, for example, kinematic or kinetic training data measured by motion capture systems. The training inputs may also comprise, for example, time-series-predicted data from other networks in the system based on processed data from the force plate for the swing.

The transform approach requires a much larger number of inputs to the network than the time-point-prediction or time-series-prediction approach, as the variation for each input variable of the inputs has to be included through all or the relevant portions of the swing. This makes training more time consuming, but the same transforms can be used as inputs for a range of different networks predicting different energy-parameters. Once training is completed, these networks can be easily and rapidly run on modern low-cost processors.

In an alternative preferred embodiment, compressed-data-prediction is used to predict all or most of the parameters of the swing, including those which can be predicted by time-series-prediction or time-point-prediction.

Time-series-prediction networks are used to directly determine the normalised variation of certain energy-parameters across all points of the swing, including the following:

- Magnitudes of segment and sub-segment local energy/forces generation/activation.
- Segment linear and angular kinetic energy levels.
- Absolute speeds of body and club segments, including club head absolute speed.
- Angular and linear positions, velocities and accelerations of body and club segments through the swing, due to displacement by the local muscle group.
- Angular and linear positions, velocities and accelerations of body and club segments through the swing.
- Angular positions, velocities and accelerations between the trunk and arm segments and between the arm and club segments.
- Type A, B and C characteristic frontal plane energy transfers.

Time-point-prediction networks are used to directly determine the time instances when certain energy-parameters occur in the swing, including the following:

- Start and completion of segment and sub-segment local energy/forces ramp-ups and ramp-downs.
- Latching and unlatching between connecting segments and sub-segments.
- Top-of-backswing events for body and club segments.
- Maximum muscle stretch-shortening between the various connecting segments.
- Times of local energy generation peaks in segments, sub-segments and club head;
- Times of angular/linear velocity and acceleration peaks in segments, sub-segments and club head;
- Times of auxiliary frontal-plane energy transfer centre-of-pressure velocity and acceleration peaks; and
- Times of commencement and termination of auxiliary frontal-plane characteristics.

When training networks, training inputs usually comprise force plate processed outputs and training outputs usually comprise the relevant measurements or calculated parameters of the players' swings. In most cases these training outputs are obtained by using conventional high-accuracy motion capture methods under carefully controlled conditions. Computer android models are additionally used to determine segment kinetic energies and segment local energy generation, also using the motion capture data. Once a player's swing has been fully recorded and checked in a manner suitable for digital processing, the work of training the various networks, involving large numbers of training iterations, can be performed automatically by an appropriately programmed system. A large number of different networks can thus be trained with little additional expenditure of human time and cost.

Some of the network outputs listed above comprises parameters which can theoretically be calculated from each other. For example, many of the time-point-predictions can be determined by the timing of peaks on the time-series-predictions. However, as mentioned previously, these data are more accurately predicted by time-point-prediction. A similar situation applies to the separate prediction of kinetic energies and segment velocities. Duplication also occurs in the separate network predictions of position, velocity and acceleration of segments, since velocity and acceleration can be determined as first and second time derivatives of position. Similarly, position or velocity can be determined by single or double integration of acceleration with respect to time. However, tests indicate that these parameters are usually more accurately predicted by specifically trained networks, and separate prediction is usually the preferred method.

Tests have shown, however, that some position parameters can be more accurately predicted by integration of the predicted velocity with respect to time, and that some velocity parameters can be more accurately predicted by integration of the predicted acceleration with respect to time. These parameters usually relate only to regions of peaks or inflexions in the plots or chronological sequences. The reason for this appears to be that the integration process can provide a smoothing of prediction noise which loses less information than the arithmetic smoothing used in the direct prediction processes. The best methods for particular applications can be established by trial.

Swing type A, B and C characterising events are readily adapted for inclusion in the training phase, being directly related to force plate COP motion, and are readily detected by the training networks on actual swings. However, much of the COP data can be used without the need for network prediction, either by direct use of the processed outputs from the force plate or calculated by the processor from these outputs. These parameters include COP positions in time, magnitudes, velocities, accelerations and lengths of displacement.

As previously mentioned, compressed-data-prediction networks are used to predict parameters which require information broadly across the swing, or if related to a specific time in the swing, also require significant information from other times in the swing. They are used to directly determine the following parameters:

- Category of swing type, types A, B, C and others.
- Player's body weight.
- Category of player's body type.
- Category of club played, from driver to wedge.
- Times of impact and takeaway.
- Time durations between the components of related time events, including TOB-1, TOB-2, TOB-3 and TOB-4; and durations between segment peak kinetic energies and durations between local energy activations.
- Categories of peak or inflexion normalised shapes occurring at specific events in time-series chronological sequences.
- Scaling factors for normalised values predicted by other networks. These include angular and linear positions, velocities and accelerations. They also include forces, kinetic energies and local energies. They further include scaling factors for normalised swing types A, B and C characterising events.

In the preferred embodiment, where the force plate measures side forces as well as vertical forces, the following processed network inputs have been used as a basic set of inputs for the networks, and shall be referred to as the 'basic' set of force plate inputs. They are used alone to obtain an initial compressed-data-prediction of the times of takeaway and impact, which is then used to predict a 'time-marker' input. The time marker input assigns a normalising number from 0 to 1 for all sampled times for use in the other networks. For example a parameter sampled half way through the swing is assigned a time marker input of 0.5. The basic set of inputs comprises the following:

X, Y and Z forces from each of the eight sensor positions.

COP position in the X direction for the left foot, the right foot and for the combination of both feet.

COP position in the Y direction for the left foot, the right foot and for the combination of both feet.

COP velocity in the X direction for the left foot, the right foot and for the combination of both feet.

COP velocity in the Y direction for the left foot, the right foot and for the combination of both feet.

COP acceleration in the X direction for the left foot, the right foot and for the combination of both feet.

COP acceleration in the Y direction for the left foot, the right foot and for the combination of both feet.

Various networks were tested to determine the relative importance of these inputs to the accuracy of prediction and it was found that most of the networks responded similarly. Where it is used, the time-marker input was found to be the most influential input. It was found that COP velocity for the right foot, both in the X and Y directions had the next greatest influence on accuracy. COP position for the combination of both feet, both in the X and Y directions were also important. All of the X, Y and Z direct forces at the individual sensor positions were found to be important. COP accelerations, for both feet and in all directions, were the least influential parameters of the above set and their omission only causes a slight reduction in prediction accuracy.

In the preferred embodiment, where the force plate does not measure side forces, the number of force plate network inputs in the basic set is reduced by sixteen as there are no X and Y force inputs from the eight sensor positions.

Some of the outputs from some compressed-data-predictions are used as inputs to other networks, including other compressed-data-prediction networks. Most networks predict more accurately if trained with inputs including a time-marker and identifications of club type, player body type, and swing type A, B or C.

Typical examples of results from some of the basic time-series-prediction networks are shown in accompanying FIGS. 6 to 12. These networks were trained with the basic force plate inputs set, including X and Y side forces. All of the examples shown are real examples showing network predicted results with actual swings with driver clubs, completely separate from the training process. The vertical axis shows the normalised value of the variable, with its peak value represented by the value 1 and its minimum value represented by the value 0. The horizontal axis shows time after the takeaway event in seconds. The actual value, as measured by the motion capture system, is shown by the dashed line A. The processed predicted value as predicted by the network is shown as the solid line B.

Figure 6:
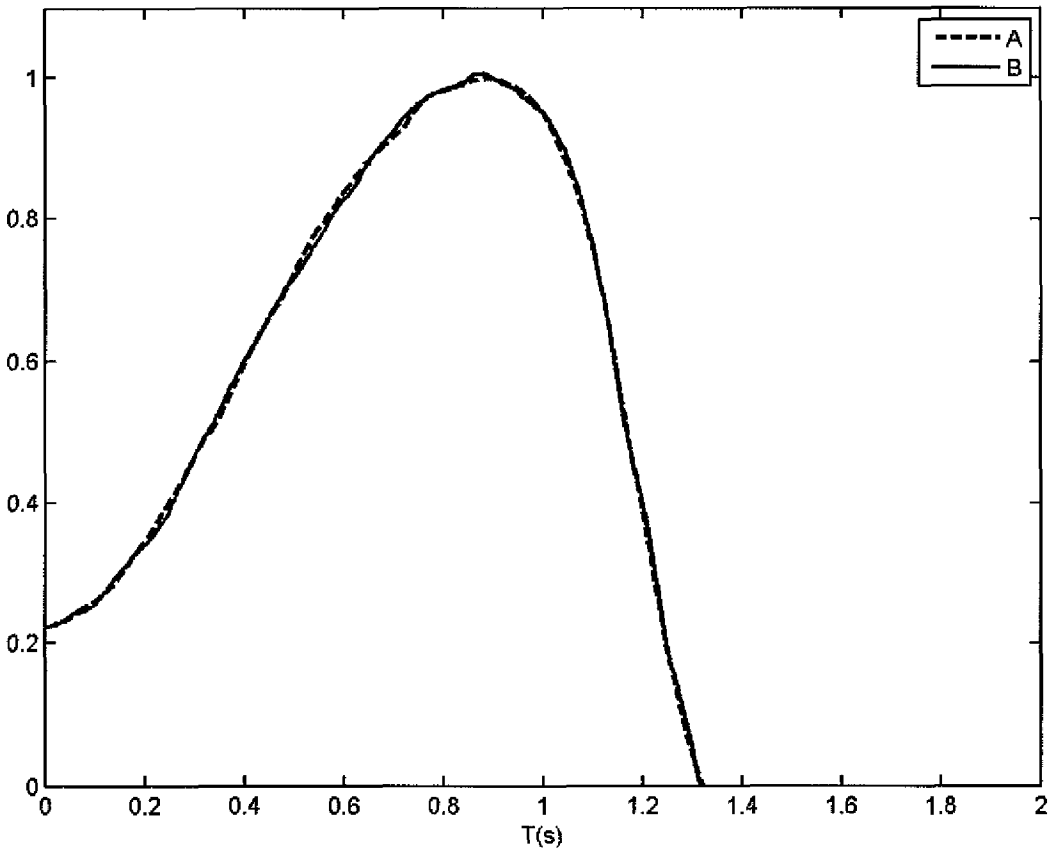
FIG. 6 shows a neural network prediction of pelvis segment angular position over the course of a swing.
Figure 7:
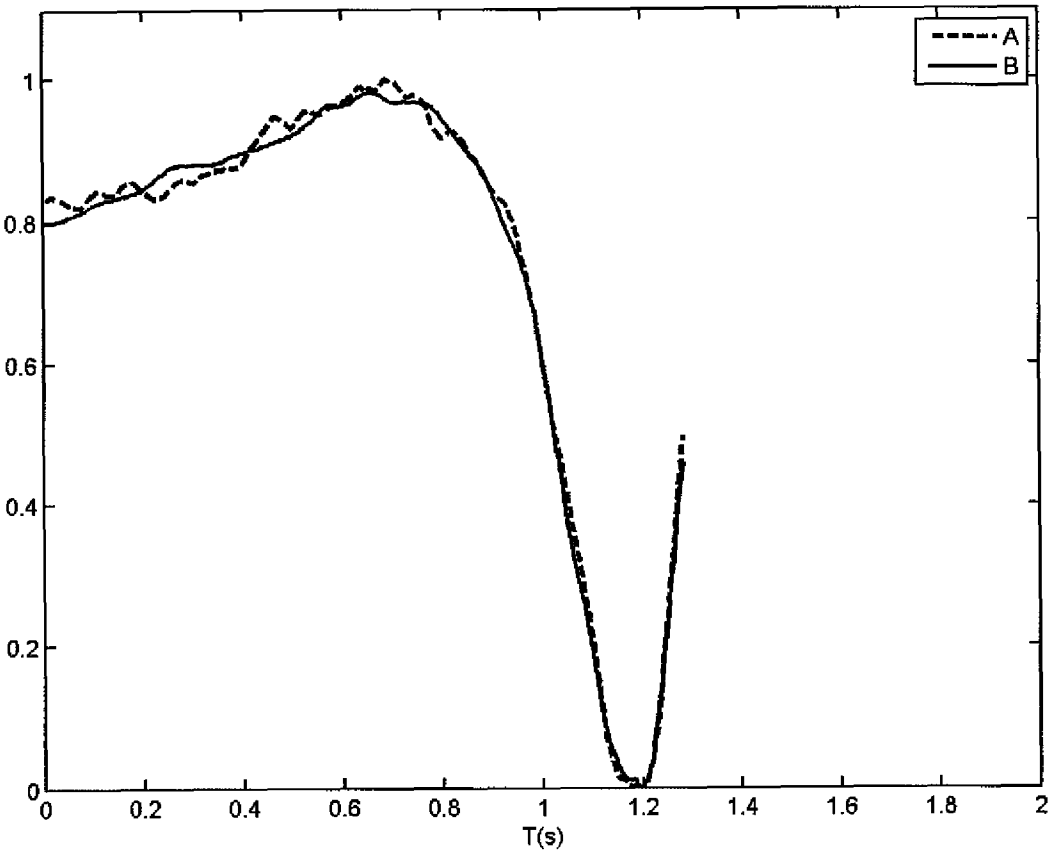
FIG. 7 shows a neural network prediction of pelvis segment angular velocity over the course of a swing.
Figure 8:
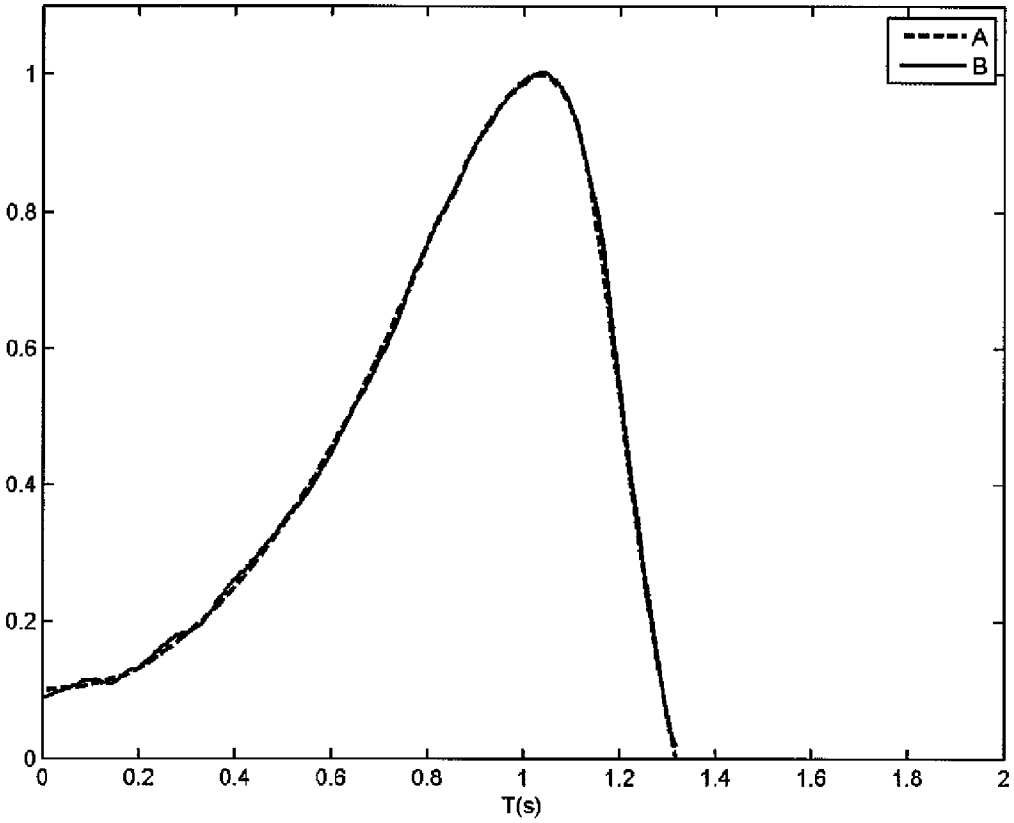
FIG. 8 shows a neural network prediction of shoulders/trunk segment angular position over the course of a swing.
Figure 9:
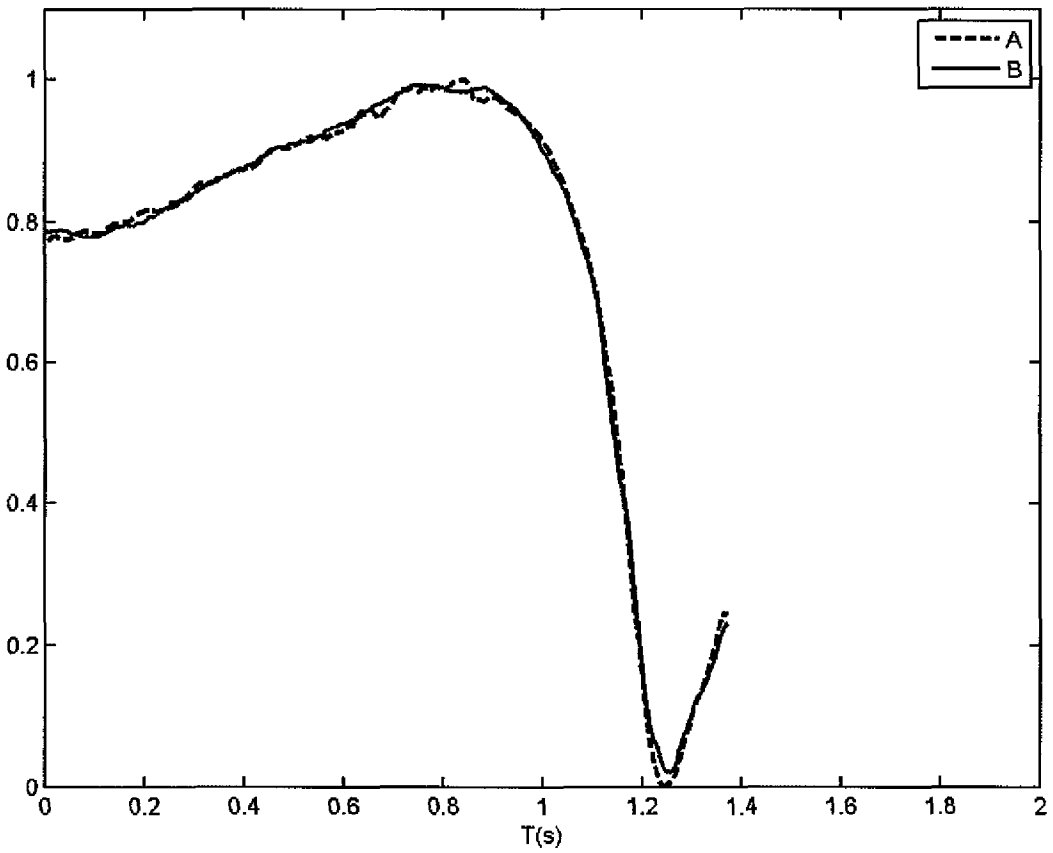
FIG. 9 shows a neural network prediction of shoulders/trunk segment angular velocity over the course of a swing.
Figure 10:
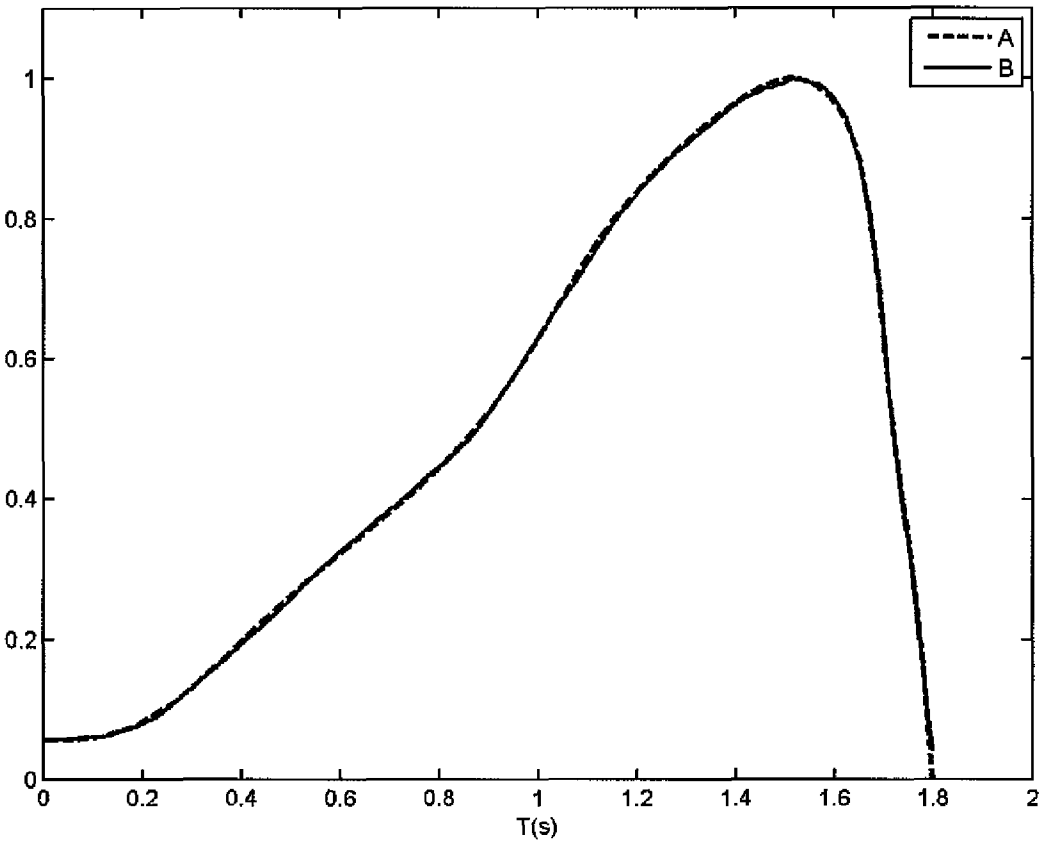
FIG. 10 shows a neural network prediction of shaft/club segment angular position over the course of a swing.
Figure 11:
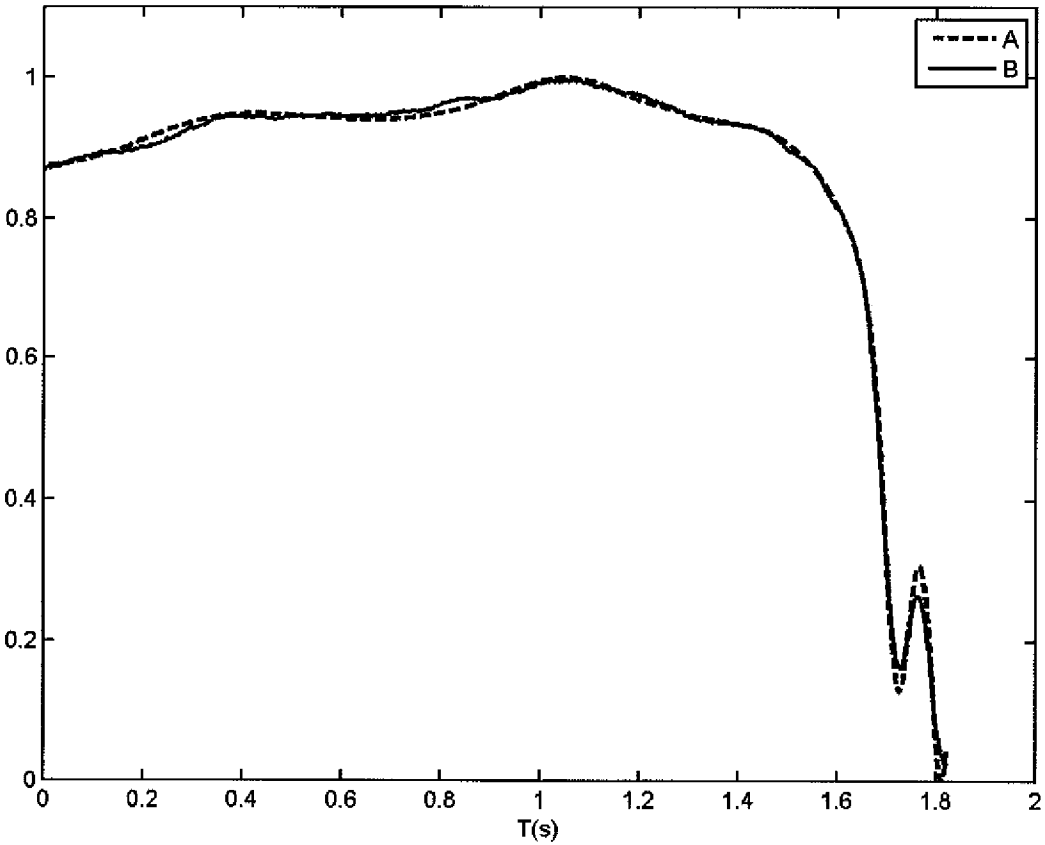
FIG. 11 shows a neural network prediction of shaft/club segment angular velocity over the course of a swing.
Figure 12:
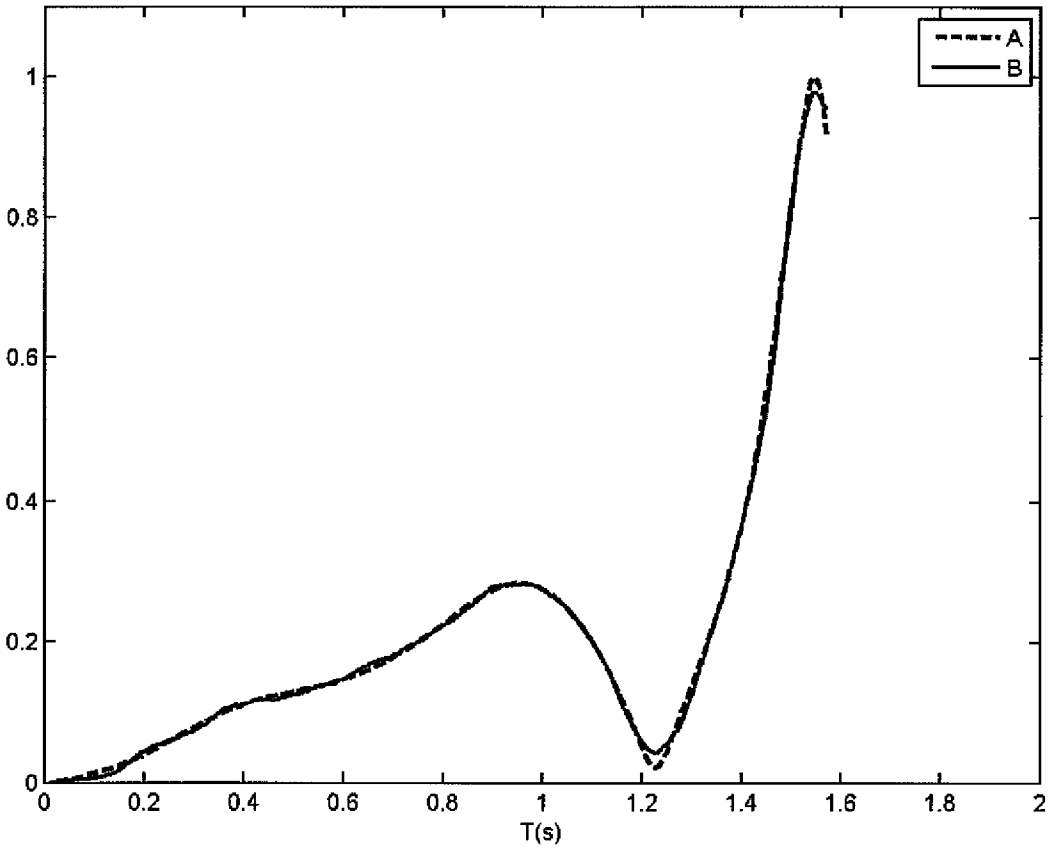
FIG. 12 shows a neural network prediction of absolute club head speed over the course of a swing.

FIG. 6 shows predicted pelvis (S1) angular position with time. FIG. 7 shows predicted pelvis (S1) angular velocity with time. FIG. 8 shows predicted shoulders (S2) angular position with time. FIG. 9 shows predicted shoulders (S2) angular velocity with time. FIG. 10 shows predicted club shaft (S4) angular position with time. FIG. 11 shows predicted club shaft (S4) angular velocity with time. FIG. 12 shows predicted absolute club head speed with time.

What is immediately clear from these plots is that the system is capable of predicting the parameters with remarkable accuracy. In most case lines A and B are substantially co-linear, indicating very high levels of accuracy over most of the swing. It will be noted that these two plots are, of course, obtained by completely independent methods. It can additionally be seen from the plots that the 'actual' measured results also sometimes display noise which is not a true reflection of the actual swing. This can be most noticeably seen in the early stages of FIG. 7 and FIG. 9 where line A displays considerable instability, which would not have been present in the actual motion. It can be seen that this noise is removed in the predicted result, line B. Where this occurs, the predicted result is actually locally more accurate than the motion capture results.

It can also be seen from the plots that lines A and B show greatest divergence where maximum or minimum peaks occur. In the examples shown, these divergences most noticeably occur in FIG. 11 and FIG. 12. These divergences occur at points in the plots which have less typical characteristics than the general format of the plot, and thus are less well handled by a network trained to construct the entire plot. As mentioned previously, these peaks or inflexions can be adjusted to a high level of accuracy by applying the results of time-point-prediction networks and data-compression-prediction networks which are specifically trained in relation to the specific peak or inflexion. The former accurately locates the point in time at which the peak or inflexion occurs. The latter accurately identifies the category of shape appropriate to the peak or inflexion. Peaks and inflexions can also be more accurately represented by using higher sampling rates in the relevant region of the plot and by using specifically adapted curve fitting methods.

Figure 13:
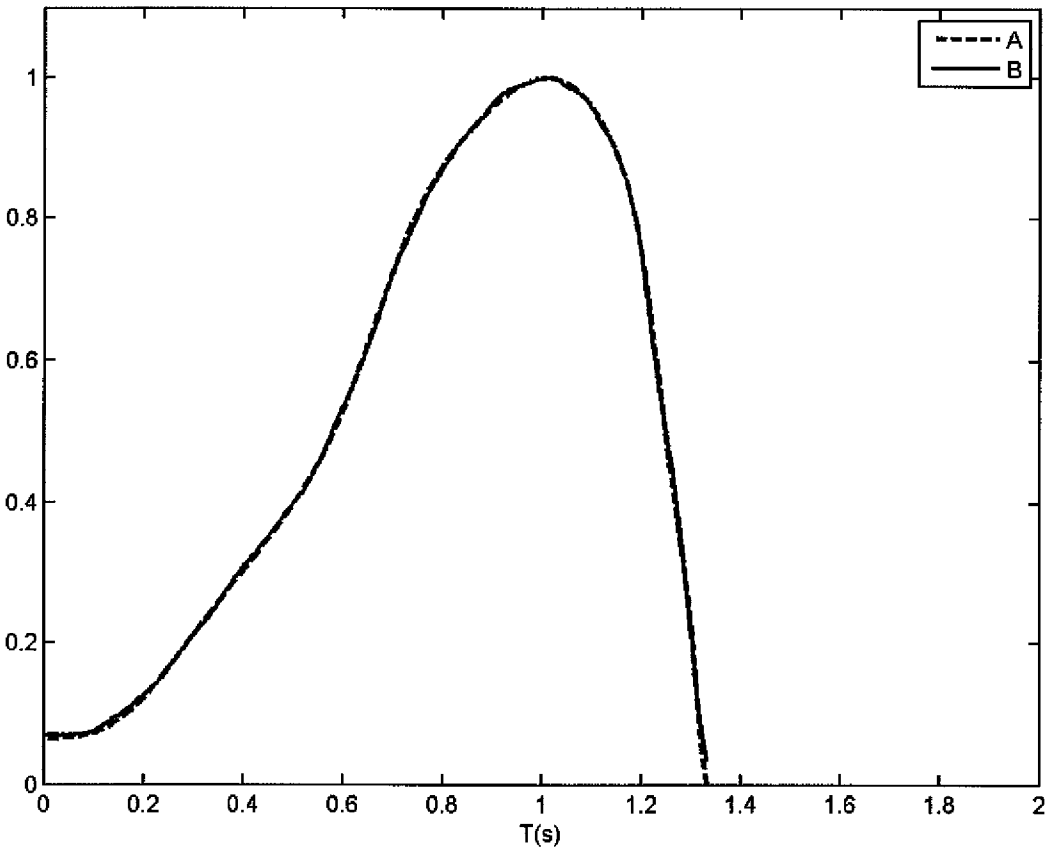
FIG. 13 shows a neural network prediction of shaft/club segment angular velocity over the course of a swing, where network inputs include various processed parameters and side forces.
Figure 14:
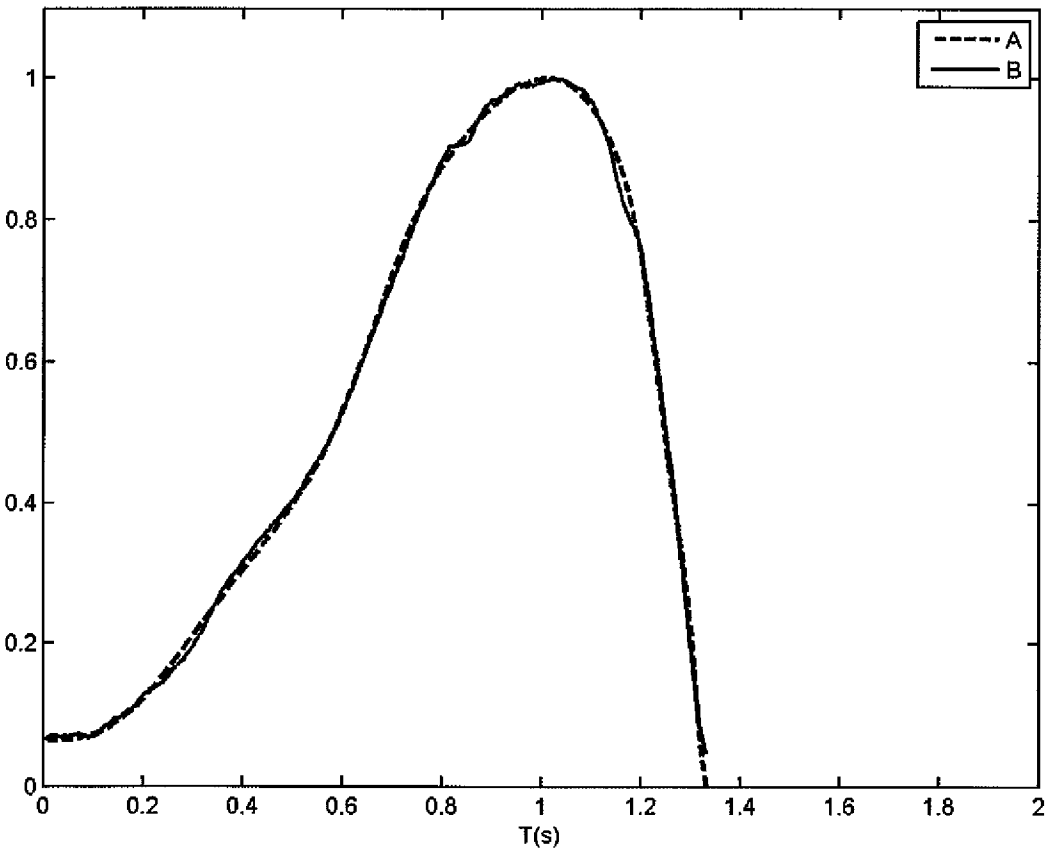
FIG. 14 shows a neural network prediction of shaft/club segment angular velocity over the course of the same swing as shown in FIG. 13, where network inputs include various processed parameters but do not include side forces.
Figure 15:
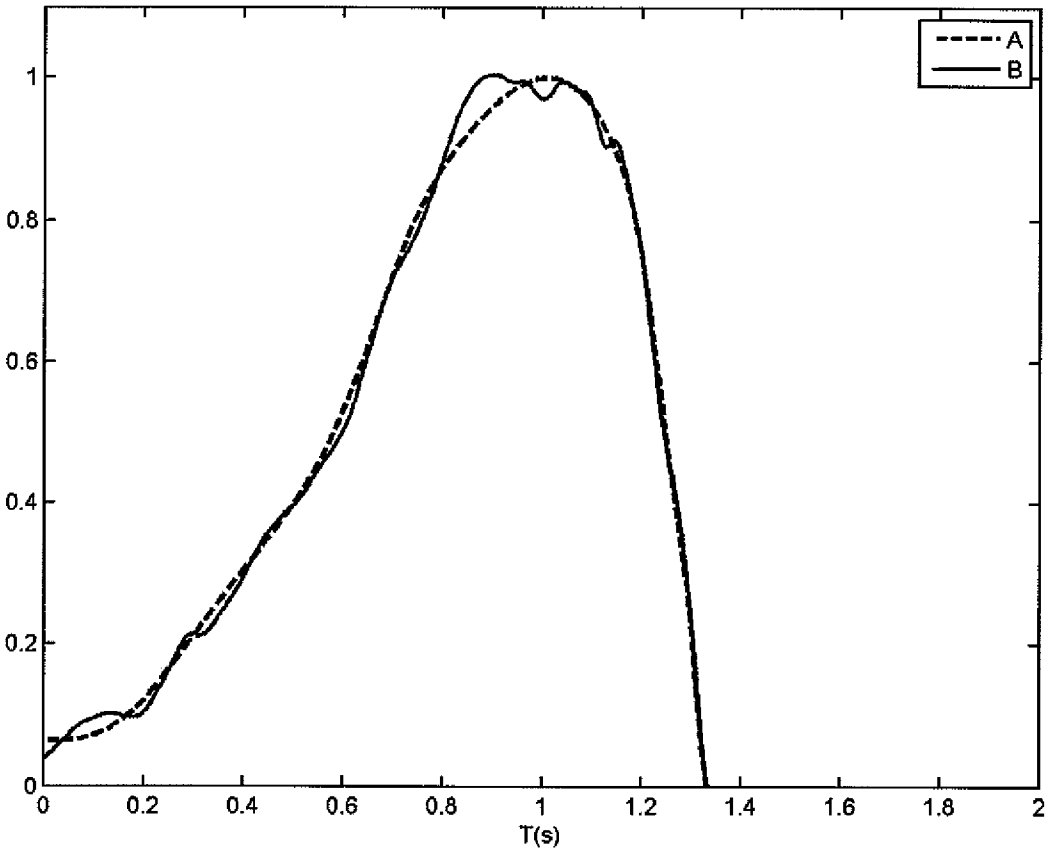
FIG. 15 shows a neural network prediction of shaft/club segment angular velocity over the course of the same swing as shown in FIG. 13, where network inputs only include direct vertical and side forces.

FIGS. 13, 14 and 15 show the influence of different types of inputs on the predicted results, taking the typical example of club shaft (S4) angular position. The three figures show predicted results for the same driver swing. In FIG. 13, the inputs comprise the full basic set of force plate inputs including side forces, in FIG. 14 the inputs comprise the full basic set of force plate inputs but without side forces, and in FIG. 15 the inputs solely comprise X, Y and Z force inputs for all eight sensor positions on the force plate.

It can be seen from the plots that FIG. 13 predicts with the greatest accuracy, FIG. 14 predicts with a little less accuracy and FIG. 15 predicts with significantly less accuracy. From this it may be concluded that processing the direct force plate outputs to provide the more complete set of force plate network inputs provides a very significant increase in accuracy, and such additional inputs are advantageously include as they involves little cost or effort in additional processing. It is also concluded that although FIG. 14 displays less accuracy than FIG. 13, it nevertheless still provides quite a high level of accuracy. It may therefore present the preferred option where force plate costs, bulk or weight is an overriding consideration, since force plates without side force measurement involve less cost in manufacture and are potentially slimmer and lighter that those which must also measure side forces.

FIG. 16 shows a typical actual example of a predicted output before and after smoothing is carried out. Line C shows the relatively noisy raw predicted result. Line B shows the smoothed predicted result. The example shows club head absolute speed for a driver swing.

The various energy-parameter data, including the predicted data, is processed in preparation for its next stage of use. Scaling factors are applied to normalised data to convert them to actual values. Time-point-predictions and data-compression-predictions are used to adjust time-series-predictions to increase their accuracies and to qualify the conditions surrounding specific events.

In a preferred embodiment, the energy-parameters are automatically analysed, although they may also be prepared for human presentation, for example for use by experts employed in devising automatic analysis of the data or for direct use by coaches for immediate analysis of a player's swing.

Analysis

Various categories of techniques are employed to automatically analyse and evaluate the energy-parameters. These include:

a) Analysis and evaluation in light of the optimisation-rules.
b) Analysis and evaluation by comparison to the swings of expert players.
c) Analysis and evaluation by use of a relative noisiness method.
d) Analysis and evaluation by comparison to other swings by the same player.
e) Analysis and evaluation on a health safety basis.

All of these categories are used in the preferred embodiment. They are individually discussed in the following paragraphs.

The most important category of techniques comprises analysis and evaluation in light of the optimisation-rules. This type of analysis examines the generation of energy associated with the various body segments and sub-segments and its efficient transmission through the body. For distance shots, the analysis also examines the ability to attain maximum club head speed at ball impact. Key fundamental principles underlying the optimum generation and transmission of energy are summarised earlier in this specification and more detailed information can be determined from existing knowledge or further research. These form the basis for the analysis.

Although the principles need not be repeated here, particularly important evaluations include:

Optimum set-up of the top-of-backswing in all segments.
Optimum magnitude and timings of local energy generation in each segment.
Optimum latching and launching of segments.
Optimum transfer of energy through swing and flail transfer to the club head.
Optimum timing of peak club head speed.

An additional important category of techniques comprises a comparison to the relevant energy-parameters of the equivalent swing or swing range of an appropriate expert model. These are complementary to the approach involving the optimisation-rules. It recognises that the golf swing is an extremely complex action and that further insights can be obtained by comparison to energy-parameters which are empirically known to produce optimum energy generation and transfer. The expert model is based on a synthesis of swings by expert players, adjusted to be appropriate to the swing and player under analysis. Careful in-depth analysis of expert players, such as long-hitting professionals and scratch golfers, following the principles outlined in this specification, displays tendencies to traits which are increasingly less common in progressively less accomplished players. Some of these 'expert traits' have obvious scientific basis, but others are more subtle and their underlying benefits are not obvious. These expert traits include the timing and varying magnitudes of local energy generation, the manner in which segments are unlatched and launched, and the timed mechanics of the more distal swing and flail mechanisms. Few if any expert players display all expert traits; indeed most expert players display some obvious errors in the detailed break-down of their swings. The synthesis comprise a model where errors are eliminated and expert traits, as most commonly displayed by experts, are retained. The synthesis is adjusted to allow for the player's body type and body weight. The basis for such adjustment can be determined from study of the experts themselves, where wide ranges of body type and weight exist.

A further category of techniques involves a characteristic which arises from the nature of raw predicted outputs of certain types of neural networks. Raw unsmoothed output from a time-point-predicted or time-series-predicted network is relatively 'noisy', being made up of a string of succeeding predictions with varying values. A typical example is shown in line C of FIG. 16. It has been observed that players who are more accomplished produce less noisy outputs, even though the smoothed final output of an expert player will not necessarily be predicted with any better accuracy than that of a less accomplished player. The accuracy of prediction is quite different to the accuracy of play. The reason for the observed phenomenon of relative noisiness being related to skill appears to lie in the way neural networks operate, with predictions being based across a wide range of parameters obtained from a consensus of performance during training. The level of noisiness can be readily quantified by various well established data processing methods, because it essentially represents the goodness of fit or quality of fit of the raw output data to the smoothed processed data. Different levels of noisiness are found in different predicted parameters and at different parts of the swing, but average levels for accomplished swings can be readily established and used as benchmark values for each predicted parameter across all parts of the swing. Appropriate thresholds can be set for permissible departures from benchmark levels. If a swing has its levels of noisiness compared to the benchmark model, the analysis can highlight relative weaknesses at different threshold levels across every measured aspect of the swing, without the need to search in specific areas. Although the actual problems are not directly indicated, the method provides an extremely useful diagnostic tool. Attention may, for example, be immediately drawn to portions of segment movements or energy generation which would not be readily detected where only gross effects or peak values were examined.

Another category of techniques involves comparison of the swing energy-parameters to those of other swings by the same player. The comparison may be made with a player's history of previous swings, for example checking progress as a training course develops over a period of time. The comparison may also be made with an immediate series of swings, checking the consistency of energy generation and transmission components of the swings. The comparison may additionally be made with swings carried out with other clubs, for example checking how the player translates skills used in long distance clubs, such as the driver, across to swings where maximum distance is not a requirement, but where the same efficient and smooth generation and transmission of energy remains essential.

A further category of techniques concerns evaluation and analysis on a health safety basis. This type of analysis concentrates on the identification of potential risks of injury inherent in a player's existing swings or in changes which might arise from attempted increases in energy generation and transmission.

The results of analysed energy-parameters may be prepared for human presentation, for example for use by experts employed in devising automatic interactive training routines, or for direct use by coaches to allow further human analysis and interpretation.

The resulting energy-parameters may also be analysed in conjunction with external apparatus or systems, including additional sensing means, which provide further information on the swing. For example, the apparatus of the invention may be run in co-operation with apparatus which measures the movement characteristics of the club and the ball, whereby a broader analysis of the swing may be made, including measurement and analysis of other aspects of swing accuracy.

Interactive Application

In a preferred arrangement, the system is operable to provide evaluation or analysis which does not require further human analysis or interpretation. In a preferred variation, it is used with interactive training processes where the results of the analysis are used to automatically prompt a training element within the processor software.

Automatic interactive operation has the advantage that communicated information can be arranged in a format appropriate for players or coaches who are unlikely to be interested in or properly understand the operation of energy generation or transfer mechanisms within the swing. Interactive training elements may be pre-prepared by experts familiar with energy-parameters, optimisation-rules and the art of coaching, with how swings can be improved and how improvement can be effectively communicated to a player. Automatic interactive operation has the advantage that expert tuition can be obtained by a player at relatively low cost and at times and location convenient to the player.

FIG. 5 is a block diagram showing information flow in a swing with interactive training. Descriptive abbreviations used in the figure are shown in parenthesis in the following brief description. Ground-reaction forces generated by the swing activity of the player (PLR) are detected by a detection means (DM). Information from the detection means is processed by an early-processing means (EPM), into data which better characterises the swing. This data is received by an artificial intelligence means (AIM) which processes or determines energy-parameters of the swing. These energy-parameters are processed and analysed in a processing means (PM) using techniques which include application of optimisation-rules. The analysed data are received by an interactive training means (ITM) which is operable to access training data (TD). Based on the analysed results and the accessed training data, the interactive training causes an interactive training element to be communication by a communication means (CM) to the player. The player may respond to the interactive training element by communicating with the interactive training means through the communication means, or may, for example, follow an instruction in the interactive training element to execute another swing. Where another swing is executed, a similar process loop is completed, and interactive training progresses as required by the interactive training system.

Figure 18:
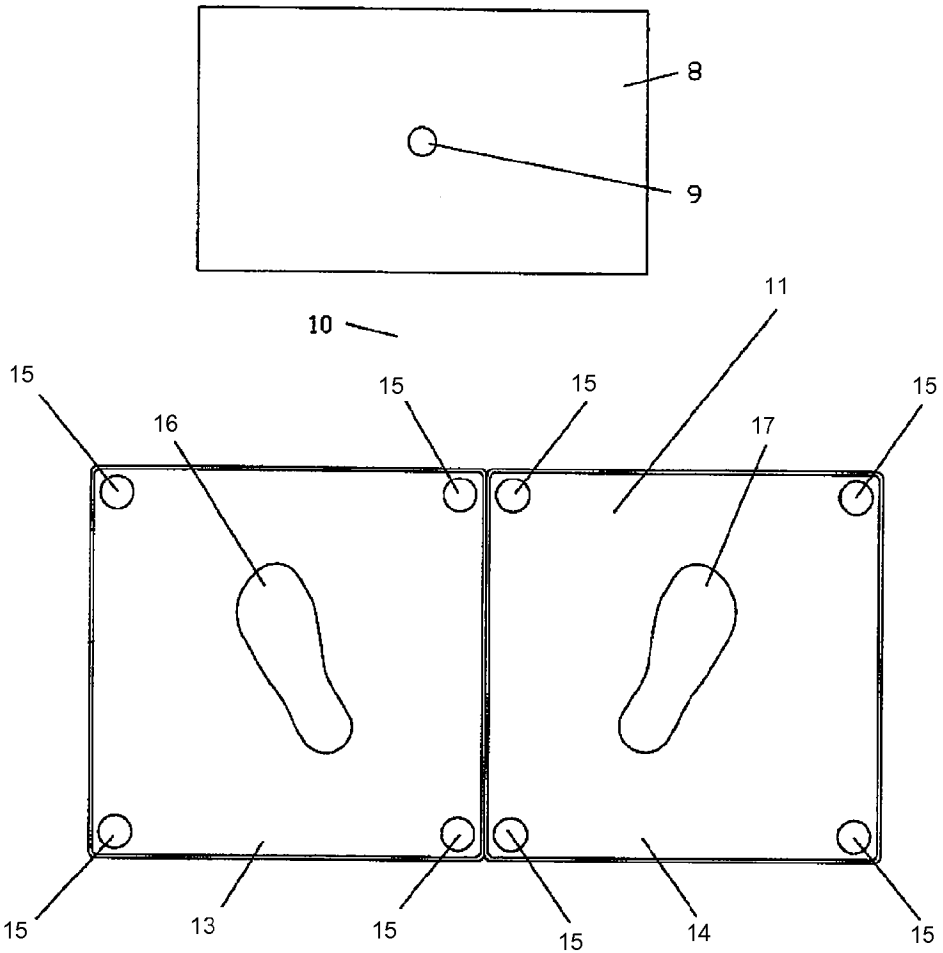
FIG. 18 shows a diagrammatic plan view of a twin platform force plate and a ball positioned on a playing surface. A player's typical foot positions are indicated on the force plate.

FIG. 18 shows a diagrammatic plan view of a force plate and a playing mat (10). Descriptive abbreviations used in the figure are shown in parenthesis in the following brief description. The force plate (11) comprises a left foot platform (13) and a right foot platform (14). Each platform is supported by sensor means (15), at four corner positions. Each sensor detects forces in the X, Y and Z directions when a load is applied to the platform. In an alternative embodiment, each sensor only detects force in the vertical or Z direction, when a load is applied to the platform. The locations of these support positions are indicated on the figure, although they are not actually visible in plan view. Force plates of this type are known in the prior art. The figure also shows the outlines of the player's feet in typical positions (16, 17). The figure additionally shows a ball (9), with the ball, playing mat (8) and standing surface disposed in relative positions suitable for shots with a driver club.

The apparatus also comprises a processing means, a data means and a communication means. The processor means comprises a programmed electronic processor or computer, which may be referred to as 'the processor'. The programmed processor comprises a facility, which may be referred to as an 'early-processing means', which is operable to process data from raw force plate signals to better characterise the swing. The processor also processes the neural networks, analyses the results and processes the interactive training routines.

The training data means comprises means which are operable to provide training data to the processor, and include a variety of data storage, retrieval and transmission devices including internet connections, CD and DVD readers and electronic memory, both external and within the processor. The communication means includes devices which allow the apparatus to communicate with the player or coach, including visual display screens and wireless audio receivers. The communication means also includes devices which allow the player or coach to communicate with the apparatus, including visual touch screens and keyboards.

In summary, this invention is an apparatus and method for measuring or analysing a golf swing. Measurement or analysis is made relative to energy generation and transfer through a player's body and club. The measurement or analysis data is principally obtained from the player's ground-reaction forces. Processed signals are analysed with an artificial intelligence system. Ground-reaction forces relate to reaction forces which occur between a standing surface and the player's feet. The apparatus and method measures or analyses a golf swing in an automatic manner or in an automatic and interactive manner.

It is to be understood that the invention is not limited to the specific details described herein, and that various modifications and alterations are possible without departing from the scope of the invention as defined in the appended method and apparatus claims.

The invention claimed is:

1. A method for analyzing a golf swing; comprising the features of:

(A) obtaining information on a golf swing by measuring information with measurement means where the information allows determination of specific parameters related to energy generation and transmission through the body to the distal end of the club when golf swings are executed, these parameters being referred to as energy-parameters;

where information measured by measurement means includes a selection from ground-reaction force information from the golf swing, measured by force measurement means including force plates and pressure pads, and kinematic information from the golf swing, measured by motion capture means including electromagnetic motion capture systems and optical motion capture systems;

(B) determining energy-parameters of the golf swing by automatically processing the measured information with an electronic processor which is operable to determine energy parameters of the golf swing; and (C) analyzing the golf swing by automatically evaluating said energy-parameters with an electronic processor which is operable to analyze the swing against predetermined criteria accessible by or provided to the said processor specifying how a swing is influenced by such energy-parameters, these criteria being referred to as optimizing-rules;

where (D) evaluation of energy-parameters, using the electronic processor which analyzes the golf swing, is automatically performed with the player and club modeled within the processing calculations as a kinetic chain of a selection of segments and sub-segments linked by joints;

where segments, and sub-segments, comprise notionally rigid sections of the player's body and club, and include a selection from club segments and player's lower body, upper body, upper trunk, lower trunk, pelvis, right arm, right upper arm, right lower arm, right hand, right leg, left arm, left upper arm, left lower arm, left hand, left leg, arms, hands and legs segments;

and where joints include a selection from shoulders, elbows, wrists, right shoulder, right elbow, right wrist, left shoulder, left elbow, left wrist, joints between upper and lower body, between upper trunk and lower trunk, between trunk and pelvis, between lower trunk and pelvis, between pelvis and legs, and between hands and club;

(E) energy-parameters are automatically evaluated by the electronic processor which analyzes the golf swing in relation to a selection from energy generated by muscles associated with a joint between a segment and a proximal segment and energy transferred to a segment from proximal segments, where the club head end of the chain is designated the distal end and the feet-ground connection is designated the proximal end in the processor, and where a segment comprises a selection from a segment and a sub-segment; and (F) energy-parameters include a selection from:

parameters related to energy generated by muscles associated with a selection from the following joints: shoulders, elbows, wrists, right shoulder, right elbow, right wrist, left shoulder, left elbow, left wrist, joints between upper and lower body, between upper trunk and lower trunk, between trunk and pelvis, between lower trunk and pelvis, between pelvis and legs, and between hands and club;

and parameters related to energy transfer including a selection from latch transfer, launch transfer, sling transfer, flail transfer and radius-reduction transfer of kinetic energy, where;

latch transfer of kinetic energy, is defined as a transfer from one segment to another along the chain by latching the segment to an accelerating proximal segment, such that the segment is accelerated along with the proximal segment by energy which is associated with the proximal segment; launch transfer of kinetic energy to a segment, is defined as a transfer from a proximal segment, where momentum is exchanged and kinetic energy is transferred when the local energy of the segment is used to launch the segment off the proximal segment; sling transfer of kinetic energy, is defined as a transfer by forces moving the target-side shoulder joint and slinging the distal segments in an arc which accelerates the distal portions; flail transfer of kinetic energy, is defined as a transfer to the most distal end of the existing kinetic energy in two connected segments which are rotating and translating in the same direction, where the proximal segment and the proximal end of the distal segment are decelerated by centrifugal forces acting on the segments; and radius-reduction transfer of kinetic energy, is defined where the rotating player reduces the angular moment of inertia of the body by reducing the effective radius of rotation, causing acceleration of the more distal parts.

2. A method according to claim 1, where useful information is measured by the measurement means during the swing to automatically determine a combination of energy-parameters, using the electronic processor which determines energy-parameters of the swing;

a combination of energy-parameters is automatically determined by said electronic processor from said useful information; and said combination of energy-parameters is automatically evaluated by the electronic processor, which analyzes the swing, to analyze the swing in light of an optimizing-rule.

3. A method according to claim 1, comprising analyzing a golf swing without dependence on the intervention of a human expert.

4. A method according to claim 1, wherein analyzing a golf swing relates to improving the golf swing by providing information related to a selection from obtaining maximum club head speed, promoting accuracy, improving control, improving consistency and identifying risks of injury.

5. A method according to claim 1, wherein energy-parameters include a selection from the following parameters:

start and completion times of segment and sub-segment local energy/forces ramp-ups;

start and completion times of segment and sub-segment local energy/forces ramp-downs;

magnitudes and durations of segment and sub-segment local energy/forces activations, including average and peak values;

times and transition characteristics of latching between connecting segments;

times and transition characteristics of unlatching between connecting segments;

segment linear and angular kinetic energy levels and times of peak values;

angular positions, velocities and accelerations of body and club segments through the swing, including peak velocities and accelerations, due to displacement by the local muscle group;

linear positions, velocities and accelerations of body and club segments through the swing, including peak velocities and accelerations, due to displacement by the local muscle group;

absolute angular positions, velocities and accelerations of body and club segments through the swing, including peak velocities and accelerations;

absolute linear positions, velocities and accelerations of body and club segments through the swing, including peak velocities and accelerations;

absolute speeds of body and club segments, including club head absolute speed;

angular positions, velocities and accelerations between the trunk and arm segments and between the arm and club segments;

times and transition characteristics of top-of-backswing events for body and club segments;

magnitudes of angles between the various connecting segments at top-of-backswing events;

times of maximum muscle stretch-shortening between the various connecting segments;

magnitudes of angles between the various connecting segments at times of maximum muscle stretch-shortening between those segments;

latch transfer of kinetic energy, defined as a transfer from one segment to another along the chain by latching the instant segment to an accelerating proximal segment, such that the instant segment is accelerated along with the proximal segment by energy which is generated at, or existing at, the proximal segment;

launch transfer of kinetic energy, defined as a transfer from a proximal segment to an instant segment, where momentum is exchanged and kinetic energy is transferred when the local energy of the instant segment is used to launch the instant segment off the proximal segment;

sling transfer of kinetic energy, defined as a transfer by forces translating or rotating the target-side shoulder joint and slinging the distal segments in an arc which accelerates the distal portions;

flail transfer of kinetic energy, defined as a transfer to the most distal end of the existing kinetic energy in two connected segments which are rotating and translating in the same direction, where the proximal segment and the proximal end of the distal segment are decelerated by centrifugal forces acting on the segments;

radius-reduction transfer of kinetic energy, where the rotating player reduces the angular moment of inertia of the body by reducing the effective radius of rotation, causing acceleration of the more distal parts;

development of potential gravitational energy on the backswing and early downswing;

conversion of potential gravitational energy to kinetic energy on the downswing;

development of club shaft potential strain energy on the downswing;

conversion of club shaft potential strain energy to kinetic energy on the downswing;

category of auxiliary frontal plane energy generation and transfer;

characteristics of auxiliary frontal plane energy generation and transfer;

center-of-pressure positions, velocities, accelerations and range of movement in relation to frontal plane energy-parameters.

6. A method according to claim 1, wherein the optimizing-rules include a selection from the following listed rules, which are presented in the format of criteria which when present or accentuated tend to optimize the swing and when absent or reduced tend to de-optimize the swing:

segments and sub-segments should attain sufficient angular speed and associated kinetic energy in the backswing to tightly wind-up the segments in their top-of-backswing positions, with the segments being wound-up in the time sequence of proximal-to-distal;

the sequenced wind-up of segments and sub-segments should he smooth and coordinated;

the degree of wind-up between connecting segments and sub-segments should be such as to provide optimum stretch-shortening of all local muscle groups, and also optimum elastic stretching of relevant body parts;

as they attain the top-of-backswing positions, each segment and sub-segment should change rapidly from backswing to downswing rotation;

downswing should commence with the most-proximal segment powered by its local muscle group;

the most-proximal segment local muscle group should ramp up to a higher level of activation as rapidly as possible;

all other segments and sub-segments should commence their downswing motions, commencing from their top-of-backswing positions, latched in proximal-to-distai chain formation to the most-proximal segment, with all powered by the most-proximal segment local muscle group;

all segments and sub-segments should commence their downswing motions latched in chain formation to the most-proximal segment, the local muscle groups of these segments and sub-segments, distal to the most-proximal segment, are optimally further stretch-shortened and elastically stretched, this further optimum stretch shortening and elastic stretching being completed when each segment or sub-segment attains the same speed as its proximal neighbor in the chain;

other that where the local muscle group of a segment or sub-segment is significantly more powerful than its distal neighbor, a segment or sub-segment should end its principal local energy generation before the distal segment is launched from it, the distal segment or sub-segment only launching after its proximal neighbor has attained maximum speed;

a segment or sub-segment should unlatch from its proximal neighbor before launching from it;

the local muscle group of each segment and sub-segment should remain at a low level of activation until the instant segment unlatches from and launches off the proximal segment, whereupon it ramps up to and maintains a higher level of activation; (in the case of the muscle group of the most proximal segment, this commences from the start of the downswing), the higher level of activation is ended and the local muscle ramps back down to a low-level of activation as the distal segment unlatches from and launches off the instant, the rule exception being that the arm segment muscle group continues activation after the club segment unlatches, due to the muscle group of the arm segment being significantly more powerful than that of the club segment;

local muscle groups of segments and sub-segments should ramp-up and ramp-down, between higher and lower activation levels, as rapidly as possible;

when it ramps-up to the higher levels of activation, the muscle group of each segment and sub-segment should maintain the higher optimum level of activation to accelerate the segment to the required maximum velocity as quickly as possible, the muscle group should ramp-down to the lower level as rapidly as possible after the segment attains the required maximum velocity;

the levels of energy activation and required segment velocities should be varied with the requirements of the swing, and should be optimally maximized for swings requiring maximum club head speed, and optimally reduced where lower club head speeds are required;

segment and sub-segment motions should proceed smoothly and with optimum mechanical efficiency, linear motions should be in the optimum mechanically efficient directions and angular motions should occur about optimum mechanically efficient axes;

an optimal latch angle should be set between the arm and club segments at the commencement of the downswing of these segments, which promotes optimal flail energy transfer between these segments when they unlatch later in the downswing, this angle lying between 60° and 70°;

an optimum latch angle between the arm and club segments should be maintained to the point in the downswing where unlatching causes the club head to subsequently maximize its speed and to attain this maximum speed at impact;

for swings requiring high club head speeds, an optimum latch angle between the arm and club segments should be maintained to the point in the downswing where unlatching causes the club segment to attain maximum angular speed shortly before impact, allowing released strain energy from the deflected club shaft to accelerate the club head to subsequently maximize its speed and to attain this maximum speed at impact;

auxiliary-frontal-plane energy generation and transfer should be categorized as one of several types which do not intermix, there appearing to be one most common type, one moderately common type and at least one other uncommon type, the moderately-uncommon type displaying a reversal in center-of-pressure linear movement away from the target direction after an initial movement towards it, which is absent for the common type;

in the common type of auxiliary-frontal-plane energy generation and transfer, where the center-of-pressure is not reversed after its first movement towards the target, where swings require maximum club head speed, the player should move such that his or her center-of-pressure in the target direction is maximized in its length of linear movement and is maximized in its linear speed;

in the common type of auxiliary-frontal-plane energy generation and transfer, where the center-of-pressure is reversed after its first movement towards the target, where swings require maximum club head speed, the player should move such that his or her center-of-pressure trace is first maximized in linear speed in the target direction, and is then maximized in linear speed away from the target direction.

7. A method according to claim 1, which comprises the steps of:

a) obtaining ground-reaction force information during the swing;

b) processing the information into data which better characterizes the swing; and c) receiving and processing the processed data by artificial intelligence.

8. A method according to claim 7, wherein ground-reaction force information is obtained as load response information, rather than deformation response information;

some of the information is processed separately from other information; and information is processed into data which better characterizes the swing, before being received and processed by artificial intelligence, casing a selection from the following techniques:

a) smoothing of the information stream, such as the use of an arithmetic moving average;

b) scaling to ensure comparable information values;

c) temperature stabilizing, to overcome errors from changing temperatures;

d) voltage stabilizing, to overcome errors from changing system voltages;

e) conversion to center-of-pressure X and Y positions on individual feet or across a combination of both feet;

f) conversion to center-of-pressure X and Y velocities on individual feet or across a combination of both feet; and g) conversion to center-of-pressure X and Y accelerations on individual feet or across a combination of both feet.

9. A method according to claims 7, wherein the artificial intelligence comprises use of trained artificial neural network methods; and separate networks are used to predict different energy-parameters.

10. A method according to claim 7, wherein energy-parameters are automatically analyzed or evaluated by use of a relative noisiness method, where the method relates to analyzing the noise level of a predicted network outputs for a swing, or portion of a swing, and inferring better performance with reducing noise level; and analysis includes a selection from the following features:

a) comparison is made to the noisiness level of a reference swing or other reference value;

b) comparison is made to a reference swing based on the play of expert players;

c) levels of noisiness are established as measures of goodness of fit or quality of fit of the raw output data to smoothed output data; and d) analysis or evaluation is used to highlight relative weaknesses or strengths at different threshold levels across the swing.

11. A method according to claim 7, which includes a selection from the following;

a) information is processed in an interactive manner, and the method is operable to prompt a training element and communicate the training element to the player;

b) interactive training elements are pre-prepared by experts familiar with such energy generation and transfer within the swing, with how they can be improved and how improvement can be effectively communicated to a player; and c) sensory information is processed; the artificial intelligence obtains the energy-parameters from the processed information; the energy-parameters are processed to analyze or evaluate the swing; and interactive training routines are processed and communicated to a user, such as a player or coach.

12. A method according to claim 7, wherein ground-reaction forces are separately sensed or measure for the player's left and right feet.

13. A method according to claim 1, wherein energy-parameters are automatically analyzed or evaluated using all or a selection from the following techniques:

a) evaluation or analysis in light of the optimization-rules;

b) evaluation or analysis by comparison to the swings of expert players;

d) evaluation or analysis by comparison to other swings by the same player; and d) evaluation and analysis on a health safety basis.

14. A method according to claim 1 which includes a selection from:

a) the prior step of determining that parameters which are important to analyzing golf swings include those related to energy generation and transmission through the body when swings are executed;

b) the prior step of identifying that parameters which are important to analyzing golf swings include those related to energy generation and transmission through the body when swings are executed;

c) the prior step of determining the energy-parameters;
d) the prior step of identifying the energy-parameters;
e) the prior step of determining the optimizing-rules; and
f) the prior step of identifying the optimizing-rules.

15. An apparatus for analyzing a golf swing comprising:

(A) measurement means which are operable to measure and obtain information on a golf swing, where the information allows determination of specific important parameters related to energy generation and transmission through the body to the distal end of the club when golf swings are executed, these parameters being referred to as energy-parameters;

where measurement means include a selection from force measurement means, including force plates and pressure pads, which are operable to measure ground-reaction force information from the golf swing, and motion capture measurement means, including electromagnetic motion capture systems and optical motion capture systems, which are operable to measure kinematic information from the golf swing;

(B) an electronic processor which is operable to determine energy-parameters of the golf swing by automatically processing the measured information; and (C) an electronic processor which is operable to analyze the golf swing by automatically evaluating said energy-parameters against predetermined criteria accessible by or provided to the processor specifying how a swing is influenced by such energy-parameters, these criteria being referred to as optimizing-rules;

wherein (D) evaluation of energy-parameters is operable to be automatically performed by the electronic processor, which analyzes the golf swing, with the player and club modeled. within the processing calculations as a kinetic chain of a selection of segments and sub-segments linked by joints;

where segments and sub-segments comprise notionally rigid sections of the player's body and club, and include a selection from club segments and the player's lower body, upper body, upper trunk, lower trunk, pelvis, right arm, right upper arm, right lower arm, right hand, right leg, left arm, left upper arm, left lower arm, left hand, left leg, arms, hands and legs segments;

and where joints include a selection from shoulders, elbows, wrists, right shoulder, right elbow, right wrist, left shoulder, left elbow, left wrist, joints between upper and lower body, between upper trunk and lower trunk, between trunk and pelvis, between lower trunk and pelvis, between pelvis and legs, and between hands and club;

(E) the electronic processor, which analyzes the golf swing, is operable to automatically evaluate energy-parameters in relation to a selection from energy generated by muscles associated with a joint between a segment and a proximal segment and energy transferred to a segment from proximal segments, where the club head end of the chain is designated the distal end and the feet-ground connection is designated the proximal end in the processing means, and where a segment comprises a selection from a segment and a sub-segment; and (F) the electronic processor, which analyzes the swing, is operable to analyze the swing by automatically evaluating energy-parameters related to a selection from:

energy generated by muscles associated with a selection from the following joints: shoulders, elbows, wrists, right shoulder, right elbow, right wrist, left shoulder, left elbow, left wrist, joints between upper and lower body, between upper trunk and lower trunk, between trunk and pelvis, between lower trunk and pelvis, between pelvis and legs, and between hands and club; and energy transfer, including a selection from latch transfer, launch transfer, sling transfer, flail transfer and radius-reduction transfer of kinetic energy; wherein latch transfer of kinetic energy, is defined as a transfer from one segment to another along the chain by latching the segment to an accelerating proximal segment, such that the segment is accelerated along with the proximal segment by energy which is associated with the proximal segment; launch transfer of kinetic energy to a segment, is defined as a transfer from a proximal segment, where momentum is exchanged and kinetic energy is transferred when the local energy of the segment is used to launch the segment off the proximal segment; sling transfer of kinetic energy, is defined as a transfer by forces moving the target-side shoulder joint and slinging the distal segments in an arc which accelerates the distal portions; flail transfer of kinetic energy, is defined as a transfer to the most distal end of the existing kinetic energy in two connected segments which are rotating and translating in the same direction, Where the proximal segment and the proximal end of the distal segment are decelerated by centrifugal forces acting on the segments; and radius-reduction transfer of kinetic energy, is defined where the rotating player reduces the angular moment of inertia of the body by reducing the effective radius of rotation, causing acceleration of the more distal parts.

16. An apparatus according to claim 15, wherein the measurement means is operable to measure useful information during the swing to automatically determine a combination of energy-parameters, using the electronic processor which determines energy-parameters of the swing;

the electronic processor which determines energy-parameters is operable to automatically determine said combination of energy-parameters from said useful information; and the electronic processor which analyzes the swing is operable to subsequently automatically evaluate said combination of energy-parameters, to analyze the swing in light of an optimizing-rule.

17. An apparatus according to claim 15, wherein the apparatus is operable to carry out analysis without dependence on the intervention of a human expert.

18. An apparatus according to claim 15, wherein analyzing a golf swing relates to improving the golf swing by providing information related to a selection from obtaining maximum club head speed, promoting accuracy, improving control, improving consistency and identifying risks of injury.

19. An apparatus according to claim 15, wherein the energy-parameters include a selection from the following parameters:

start and completion times of segment and sub-segment local energy/forces ramp-ups;

start and completion times of segment and sub-segment local energy/forces ramp-downs;

magnitudes and durations of segment and sub-segment local energy/forces activations, including average and peak values;

times and transition characteristics of latching between connecting segments;

times and transition characteristics of unlatching between connecting segments;

segment linear and angular kinetic energy levels and times of peak values;

angular positions, velocities and accelerations of body and club segments through the swing, including peak velocities and accelerations, due to displacement by the local muscle group;

linear positions, velocities and accelerations of body and club segments through the swing, including peak velocities and accelerations, due to displacement by the local muscle group;

absolute angular positions, velocities and accelerations of body and club segments through the swing, including peak velocities and accelerations;

absolute linear positions, velocities and accelerations of body and club segments through the swing, including peak velocities and accelerations;

absolute speeds of body and club segments, including club head absolute speed;

angular positions, velocities and accelerations between the trunk and arm segments and between the arm and club segments;

times and transition characteristics of top-of-backswing events for body and club segments;

magnitudes of angles between the various connecting segments at top-of-backswing events;

times of maximum muscle stretch-shortening between the various connecting segments;

magnitudes of angles between the various connecting segments at times of maximum muscle stretch-shortening between those segments;

latch transfer of kinetic energy, defined as a transfer from one segment to another along the chain by latching the instant segment to an accelerating proximal segment, such that the instant segment is accelerated along with the proximal segment by energy which is generated at, or existing at, the proximal segment;

launch transfer of kinetic energy, defined as a transfer from a proximal segment to an instant segment, where momentum is exchanged and kinetic energy is transferred when the local energy of the instant segment is used to launch the instant segment off the proximal segment;

sling transfer of kinetic energy, defined as a transfer by forces translating or rotating the target-side shoulder joint and slinging the distal segments in an arc which accelerates the distal portions;

flail transfer of kinetic energy, defined as a transfer to the most distal end of the existing kinetic energy in two connected segments which are rotating and translating in the same direction, where the proximal segment and the proximal end of the distal segment are decelerated by centrifugal forces acting on the segments;

radius-reduction transfer of kinetic energy, where the rotating player reduces the angular moment of inertia of the body by reducing the effective radius of rotation, causing acceleration of the more distal parts;

development of potential gravitational energy on the backswing and early downswing;

conversion of potential gravitational energy to kinetic energy on the downswing;

development of club shaft potential strain energy on the downswing;

conversion of club shaft potential strain energy to kinetic energy on the downswing;

category of auxiliary frontal plane energy generation and transfer;

characteristics of auxiliary frontal plane energy generation and transfer;

center-of-pressure positions, velocities, accelerations and range of movement in relation to frontal plane energy-parameters.

20. An apparatus according to claim 15 wherein the optimizing-rules include a selection from the following listed rules, which are presented in the format of criteria which when present or accentuated tend to optimize the swing and when absent or reduced tend to de-optimize the swing;

segments and sub-segments should attain sufficient angular speed and associated kinetic energy in the backswing to tightly wind-up the segments in their top-of-backswing positions, with the segments being wound-up in the time sequence of proximal-to-distal;

the sequenced wind-up of segments and sub-segments should be smooth and coordinated;

the degree of wind-up between connecting segments and sub-segments should be such as to provide optimum stretch-shortening of all local muscle groups, and also optimum elastic stretching of relevant body parts;

as they attain the top-of-backswing positions, each segment and sub-segment should change rapidly from backswing to downswing rotation;

downswing should commence with the most-proximal segment powered by its local muscle group;

the most-proximal segment local muscle group should ramp up to a higher level of activation as rapidly as possible;

all other segments and sub-segments should commence their downswing motions, commencing from their top-of-backswing positions, latched in proximal-to-distal chain formation to the most-proximal segment, with all powered by the most-proximal segment local muscle group;

all segments and sub-segments should commence their downswing motions latched in chain formation to the most-proximal segment, the local muscle groups of these segments and sub-segments, distal to the most-proximal segment, are optimally further stretch-shortened and elastically stretched, this further optimum stretch shortening and elastic stretching being completed when each segment or sub-segment attains the same speed as its proximal neighbor in the chain;

other than where the local muscle group of a segment or sub-segment is significantly more powerful than its distal neighbor, a segment or sub-segment should end its principal local energy generation before the distal segment is launched from it, the distal segment or sub-segment only launching after its proximal neighbor has attained maximum speed;

a segment or sub-segment should unlatch from its proximal neighbor before launching from it;

the local muscle group of each segment and sub-segment should remain at a low-level of activation until the instant segment unlatches from and launches off the proximal segment, whereupon it ramps up to and maintains a higher level of activation, (in the case of the muscle group of the most proximal segment, this commences from the start of downswing) the higher level of activation is ended and the local muscle ramps back down to a low-level of activation as the distal segment unlatches from and launches off the instant, the rule exception being that the arm segment muscle group continues activation after the club segment unlatches, due to the muscle group of the arm segment being significantly more powerful than that of the club segment;

local muscle groups of segments and sub-segments should ramp-up and ramp-down, between higher and lower activation levels, as rapidly as possible;

when it ramps-up to the higher levels of activation, the muscle group of each segment and sub-segment should maintain the higher optimum level of activation to accelerate the segment to the required maximum velocity as quickly as possible the muscle group should ramp-down to the lower level as rapidly as possible after the segment attains the required maximum velocity;

the levels of energy activation and required segment velocities should be varied with the requirements of the swing and should be optimally maximized for swings requiring maximum club head speed, and optimally reduced where lower club head speeds are required;

segment and sub-segment motions should proceed smoothly and with optimum mechanical efficiency, linear motions should be in the optimum mechanically efficient directions and angular motions should occur about optimum mechanically efficient axes;

an optimal latch angle should be set between the arm and club segments at the commencement of downswing of these segments, which promotes optimal flail energy transfer between these segments when they unlatch later in the downswing, this angle being between 60° and 70°;

an optimum latch angle between the arm and club segments should be maintained to the point in the downswing where unlatching causes the club head to subsequently maximize its speed and to attain this maximum speed at impact;

for swings requiring high club head speeds, an optimum latch angle between the arm and club segments should be maintained to the point in the downswing where unlatching causes the club segment to attain maximum angular speed shortly before impact, allowing released strain energy from the deflected club shaft to accelerate the club head to subsequently maximize its speed and to attain this maximum speed at impact;

auxiliary-frontal-plane energy generation and transfer should be categorized as one of several types which do not intermix, there appearing to be one most common type, one moderately common type and at least one other uncommon type, the moderately-uncommon type displaying a reversal in center-of-pressure linear movement away from the target direction after an initial movement towards it, which is absent for the common type;

in the common type of auxiliary-frontal-plane energy generation and transfer, where the center-of-pressure is not reversed after its first movement towards the target, where swings require maximum club head speed, the player should move such that his or her center-of-pressure in the target direction is maximized in its length of linear movement and is maximized in its linear speed;

in the common type of auxiliary-frontal-plane energy generation and transfer, where the center-of-pressure is reversed after its first movement towards the target, where swings require maximum club head speed, the player Should move such that his or her center-of pressure trace is first maximized in linear speed in the target direction, and is then maximized in linear speed away from the target direction.

21. An apparatus according to claim 15, wherein the apparatus includes a processing means and a detection means;

the detection means is operable to detect ground-reaction forces, and includes a standing surface and sensor means; and a) the apparatus includes an artificial intelligence means;

b) the processing means includes an early-processing means, and information from the sensor means or detection means is processable by the early-processing means, into data which better characterizes the swing, before being received by the artificial intelligence means;

c) the artificial intelligence means is operable to receive and process information from the early-processing means.

22. An apparatus according to claim 21, wherein the sensor means sense load responses, rather than deformation responses, to the standing surface;

the sensor means comprises a plurality of sensors and some information from some sensors is processed separately from some information from other sensors; and information from the sensor means or detection means is processable by the early-processing means, into data Which better characterizes the swing, before being received by the artificial intelligence means, by a selection from the following techniques:

a) smoothing of the data stream, such as the use of an arithmetic moving average;

b) scaling to ensure comparable reading between different sensors;

c) temperature stabilizing, to overcome errors from changing temperatures;

d) voltage stabilizing, to overcome errors from changing system voltages;

e) conversion to COP X and Y positions on individual feet or across a combination of both feet;

f) conversion to COP X and Y velocities on individual feet or across a combination of both feet; and g) conversion to COP X and Y accelerations on individual feet or across a combination of both feet.

23. An apparatus according to claim 22, wherein the artificial intelligence means comprises one or more trained artificial neural networks; and separate networks are used to predict different energy-parameters.

24. An apparatus according to claim 22, wherein energy-parameters are automatically analyzed or evaluated by use of a relative noisiness method, where the method relates to analyzing the noise level of a predicted network outputs for a swing, or portion of a swing, and inferring better performance with reducing noise level; and analysis includes a selection from the following features:

a) comparison is made to the noisiness level of a reference swing or other reference value;

b) comparison is made to a reference swing based on the play of expert players;

c) levels of noisiness are established as measures of goodness of fit or quality of fit of the raw output data to smoothed output data; and d) analysis or evaluation is used to highlight relative weaknesses or strengths at different threshold levels across the swing.

25. An apparatus according to claim 22, which comprises an interactive training means and a communication means, and includes a selection from the following:

a) the interactive training means communicates with the processing means to provide automatic interactive training to a player; the interactive training means is operable to prompt a training element and the communication means is operable to communicate the training element to the player;

b) interactive training elements are pre-prepared by experts familiar with such energy generation and transfer within the swing, with how they can be improved and how improvement can be effectively communicated to a player; and c) the processing means is operable to process the energy-parameters from sensory information from the detection means, process information from the artificial intelligence means, analyze the results, process the interactive training routines and communicate with the communication means.

26. An apparatus according to claim 22, wherein the detection means comprises two platforms or pad sections, which are operable to separately measure ground-reaction forces for the players left and rights feet.

27. An apparatus according claim 15, wherein energy-parameters are automatically analyzed or evaluated using a selection from the following techniques:

a) evaluation or analysis in light of the optimization-rules;

b) evaluation or analysis by comparison to the swings of expert players;

c) evaluation or analysis by comparison to other swings by the same player; and d) evaluation and analysis on a health safety basis.

28. An apparatus according to claim 15 which includes a selection from:

a) means for determining parameters for analyzing a golf swing, including the prior step of determining that parameters which are important to analyzing golf swings include those related to energy generation and transmission through the body when swings are executed;

b) means for identifying parameters for analyzing a golf swing, including the prior step of identifying that parameters which are important to analyzing golf swings include those related to energy generation and transmission through the body when swings are executed;

c) means which are operable to determine parameters including the prior step of determining the energy-parameters (the means being referred to as the energy-parameter means), the energy-parameter means also being operable to determine measurable parameters from which the energy-parameters can be determined;

d) means which are operable to identify parameters including the prior step of identifying the energy-parameters (the means being referred to as the energy-parameter means), the energy-parameter means also being operable to identify measurable parameters from which the energy-parameters can be determined;

e) analyzing means which are operable to analyze a golf swing including the prior step of determining the optimizing-rules; and f) analyzing means which are operable to analyze a golf swing including the prior step of identifying the optimizing-rules.

* * * * *